US007042431B1

(12) United States Patent
Washio et al.

(10) Patent No.: US 7,042,431 B1
(45) Date of Patent: May 9, 2006

(54) IMAGE DISPLAY DEVICE AND DRIVING METHOD OF THE SAME

(75) Inventors: Hajime Washio, Tenri (JP); Nobuhiro Kuwabara, Tenri (JP); Shigeto Yoshida, Nabari (JP); Yuji Asoh, Nara (JP); Hiroshi Yoneda, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/711,009

(22) Filed: Nov. 9, 2000

(30) Foreign Application Priority Data

Nov. 9, 1999 (JP) ..... 11-317700
Aug. 10, 2000 (JP) ..... 2000-242124

(51) Int. Cl.
*G09G 3/36* (2006.01)

(52) U.S. Cl. ..... 345/98; 345/213
(58) Field of Classification Search ..... 345/98, 345/213
See application file for complete search history.

(56) References Cited

U.S. PATENT DOCUMENTS 5,764,207 A 6/1998 Maekawa et al.
6,356,253 B1 * 3/2002 Uchino et al. ..... 345/89

FOREIGN PATENT DOCUMENTS

JP 7-295521 11/1995
JP 09-330061 12/1997
JP 11-231843 8/1999
JP 11-296148 * 10/1999

OTHER PUBLICATIONS

Korean Patent Office Action dated Jul. 31, 2002.

* cited by examiner

*Primary Examiner*—Dennis-Doon Chow
(74) *Attorney, Agent, or Firm*—David G. Conlin; Steven M. Jensen; Edwards Angell Palmer & Dodge LLP

(57) ABSTRACT

In a vertical retrace interval, a pre-charge potential or a signal potential is applied to each polarity for AC driving liquid crystal at least once each, so as to maintain fluctuations in pixel potential between the positive polarity side and the negative polarity side uniform, and minimum required potentials are supplied to the data signal line, thereby suppressing decrease in image quality without significantly increasing power consumption.

26 Claims, 16 Drawing Sheets

IMAGE DISPLAY DEVICE AND DRIVING METHOD OF THE SAME

FIELD OF THE INVENTION

The present invention relates to a driving method for an image display device, and particularly relates to an image display device which can suppress a decrease in image quality by controlling fluctuations in pixel potential when driving liquid crystals with an AC voltage and a driving method for such image display device.

BACKGROUND OF THE INVENTION

As an example of conventional image display devices, an active matrix type liquid crystal display device will be explained. As shown in FIG. 11, the known liquid crystal display device of the active matrix type includes a pixel array ARY, a scanning signal line drive circuit GD, a data signal line drive circuit SD and a pre-charging circuit PC.

The pixel array ARY includes a plurality of scanning signal lines GL1 to GLj and data signal lines SDL1 to SDLi. These scanning signal lines and data signal lines are disposed so as to form a matrix, and pixels PIX are disposed in a matrix form such that each pixel PIX is located in an area surrounded by adjoining two scanning signal lines GL and adjoining two data signal lines SDL. As shown in FIG. 12, each pixel PIX includes a switch element SW, a liquid crystal capacitor CL and a subsidiary capacitor CS.

As shown in FIG. 11, the data signal line drive circuit SD includes a shift register and a sampling circuit. The data signal line drive circuit SD is provided for sampling video signals DAT as inputted to the sampling circuit SAM in synchronization with a timing signal such as a data clock signal CKS, a data sampling start signal SPS, etc., and writing a signal corresponding to the timing of the data clock signal CKS into each data signal line SDL.

As shown in FIG. 11, the scanning signal line drive circuit GD includes a shift register. The scanning signal line drive circuit GD sequentially selects scanning signal lines GL in synchronization with a timing signal such as a scanning clock signal CKG, a scanning start signal SPG, etc., and opens and closes a switching element SW of each pixel PIX. As a result, the scanning signal line drive circuit GD writes a signal voltage of a video signal DAT as sampled by each sampling circuit SAM into a data signal line SDL, and further writes the signal voltage into a capacitor of each pixel PIX, and holds a potential of the video signal DAT in capacitors CL and CS of each pixel PIX.

The pre-charging circuit PC performs a sampling of a pre-charge potential PCV as inputted in synchronization with a timing of a pre-charge control signal PCC and writes the pre-charge potential PCV before the video signal DAT as sampled is written into each data signal line SDL. The foregoing technique is clearly disclosed in Japanese Unexamined Patent Publication No. 295521/1995 (Tokukaihei 7-295521) (Publication Date: Nov. 10, 1995).

For liquid crystal displays, it is required that an application voltage to pixels PIX applies AC potential at a predetermined cycle in order to prevent deterioration of liquid crystals. Therefore, it is required for the video signal DAT as a source of a signal to be written into pixels PIX that its polarity be inverted at a predetermined period even for the video signal DAT of the same video data.

In reference to FIG. 12, a pixel structure PIX will be explained. As shown in FIG. 12, one end of a capacitor which constitutes each pixel PIX is connected to a data signal line SDL via a switching element SW, and the other end is connected to a common electrode COM to which a counter potential VCOM is applied. More specifically, a difference in potential between a signal written into the pixel PIX via the switching element SW and the counter potential VCOM is applied to a liquid crystal through the data signal line SDL. Further, by modulating light passed through or reflected from the liquid crystal according to an effective voltage of the potential being applied to the liquid crystal, a variety of display states can be realized.

In this example, it is assumed that the counter potential VCOM is a DC potential. Namely, the polarity of the video signal, whether positive or negative is defined based on this counter potential VCOM as a reference potential.

Examples of driving methods for the liquid crystals include:

(1) 1H inverse driving method (gate line inverse driving method) for inverting a polarity of a video signal at every horizontal scan period (hereinafter referred to as 1H);

(2) frame inverse driving method for inverting a polarity of a video signal every frame of the video signal or every field of the video signal;

(3) source line inverse driving method for inverting a polarity of a video signal at every frame of the video signal or at every field of the video signal in such a manner that any adjacent two data signal lines have different polarities; and (4) dot inverse driving method in combination of the above (3) source line inverse driving method and (1) 1H inverse driving method.

Here, explanations will be given through the case of the (1) 1H inverse driving method.

For example, pixels PIX connected to the data signal line SDLn ($1 \leqq n \leqq i$) are first charged to a pre-charge potential PCV of a positive polarity or negative polarity by the pre-charging circuit PC. Subsequently, the data signal line drive circuit SD is driven by the data sampling start signal SPS and the data clock signal CKS, and samples video signals DAT of positive or negative polarity and write signals as sampled in the data signal line SDL. Subsequently, the scanning signal line drive circuit GD opens each switching element SW of a pixel PIX connected to the scanning signal line GLn ($1 \leqq n \leqq j$), to allow signals as sampled to be rewritten into respective liquid crystal capacitors CL and subsidiary capacitors CS. Then, upon completing a selection of the scanning signal line GLn, the liquid crystal capacitors CL and the subsidiary capacitors CS of the pixels PIX are separated from the data signal line SDL by the switching elements SW, and the scanning signal line drive circuit GD holds the signals as sampled and written into the pixels PIX. In this example, one end of each pixel PIX is connected to a counter potential VCOM, but the other end that is connected to the switching element SW is separated. Thus, the liquid crystal capacitor CL and the subsidiary capacitor CS of the pixel PIX are in a floating state. Further, the liquid crystal capacitor CL and the subsidiary capacitor CS of the pixel PIX are adjacent to the data signal line, and thus these capacitors have parasitic capacitances (fringe capacitances) Cf with respect to the data signal line as shown in FIG. 12.

When the pre-charge potential of negative polarity or positive polarity is written from the pre-charging circuit PC before carrying out the next scanning operation, due to the effect of the pre-charge potential via the parasitic capacitor Cf, respective potentials of the liquid crystal capacitor CL and the subsidiary capacitor CS of the pixel PIX vary as being abruptly attracted to the negative polarity side or the positive polarity side (hereinafter referred to as pixel potential fluctuations).

Then, upon completing a writing of an image into pixels PIX for the scanning signal lines GL1 to GLj (j>1), in order to save power consumption, a supply of signals from the control signal generating circuit CTL to the data signal line drive circuit SD, the scanning signal line drive circuit GD, and preliminary charging circuit PC is stopped.

Assumed, for example, that scanning signal lines of j=2m (m≧1) are disposed, and a video signal of positive polarity is written into the pixels PIX connected to the first scanning signal line GL1. Then, a video signal of negative polarity would be written in the last scanning signal line GLj (j=2m). Namely, a video signal of positive polarity is written into pixels PIX connected to odd numbered scanning signal lines, while a video signal of negative polarity is written into pixels PIX connected to even numbered scanning signal lines. In this example, the pre-charging of the data signal lines is carried out upon completing the writing of signals into the pixels PIX. Thus, after the last scanning operation, the data signal line is precharged in positive polarity. FIG. 13 shows the state where each signal and pixel polarity varies at vertical retrace interval. Assumed here that respective pixels PIX store the video signal data in different polarities.

FIG. 13 shows the potential PIXVodd of pixels connected to the odd numbered scanning line signal GLodd, the potential PIXVeven of pixels connected to even numbered scanning signal lines GLeven, pre-charge potential PCV, and signal potentials of the pre-charge control signal PCC and the data signal line SDL. A potential difference between the potential PIXVodd and PIXVeven of each pixel and the counter potential VCOM is applied to the pixel, and a transmittance of light is determined by the resulting effective voltage value.

However, as shown in FIG. 13, respective pixel potentials PIXVodd and PIXVeven vary by parasitic capacity Cf according to polarities of i) the pre-charge potential PCV supplied to the data signal line SDL by the pre-charge control signal PCC, and ii) the signal potential obtained by sampling the video signal DATA supplied from the data signal line drive circuit SD. In the vertical retrace interval, a supply of a control signal from the control signal generating circuit CTL is stopped, and thus the potential as varied according to the polarity of the last data signal line is held in the liquid crystal capacitor CL and the subsidiary capacitor CS of the pixel PIX. Therefore, fluctuations in pixel potential deviate throughout the vertical retrace interval, and thus light modulation as determined by an effective voltage of a potential applied to liquid crystals vary, thereby presenting the problem that the displayed content differs for the same video signal data. Specifically, in an event of an intermediate gray scale display, a moire appears due to differences in brightness between pixels connected to even-numbered scanning signal lines and odd-numbered scanning signal lines.

The problem of decrease in image quality occurs also in the driving method of liquid crystals adopting an AC potential for the counter potential VCOM. Fluctuations in pixel potential in this case are shown in FIG. 14. In FIG. 14, during the vertical retrace interval, the pixel potential PIXVodd and the pixel potential PIXVeven vary according to changes in pre-charge potential of the data signal line at the start of the vertical retrace interval, and the data signal line SDL is not precharged subsequently. Thus, although the pixel potential fluctuations can be reduced, a potential difference between the charge of the pixel PIX and the counter potential VCOM differs between i) the potential PIXVodd of the pixels connected to the odd-numbered scanning signal line and ii) the potential PIXVeven of the pixels connected to the even-numbered scanning signal lines, resulting in the problem of moire.

Recently, in order to reduce the power consumption of the backlight provided at the back surface of the liquid crystal display device, an attempt has been made to realize an increased aperture ratio to improve the transmittance of light for pixels PIX of the liquid crystal display device. When an aperture of the pixel PIX is increased, an area occupied by the electrodes which constitute pixels PIX becomes larger, and the distance between the data signal line and the pixel electrode is reduced. As the size of the capacitance component is anti-proportional to the distance between electrodes, as the distance is reduced, the capacitance component becomes larger. Therefore, the parasitic capacitor Cf becomes relatively larger than the liquid crystal capacitor CL and the capacitor CS shown in FIG. 12, and the problem of decrease in image quality is likely to occur.

In the foregoing prior art example, effects of the potential as charged by the pre-charging circuit PC has been discussed. However, the above-explained problem of image quality deterioration likely to occur even for the structure without the pre-charging circuit, i.e., without an applied pre-charge potential to the data signal line for the following reason. That is, an AC potential whose polarity is inverted at a predetermined period is applied to the data signal line by the data signal line drive circuit. Therefore, upon completing a writing operation for 1 screen, the potential of either polarity is supplied to the data signal line SDL, resulting in the problem of decrease in image quality as in the aforementioned case.

SUMMARY OF THE INVENTION

It is therefore an object of the present invention to provide an image display device capable of suppressing decrease in image quality due to moire by suppressing fluctuations in pixel potential caused by fluctuations in potential of a data signal line in a vertical retrace interval without increasing power consumption, and to provide a driving method for such image display device.

In order to achieve the above object, an image display device in accordance with the present invention is characterized by including:

a plurality of pixels arranged in a matrix form;

a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal;

a display section including the plurality of pixels, scanning signal lines and data signal lines, for displaying an image based on a video signal to be inputted to the data signal line drive circuit; and a pre-charging circuit for supplying a predetermined pre-charge potential to the plurality of data signal lines according to the pre-charge control signal from an external section in a predetermined interval, wherein in a vertical retrace interval, the pre-charge potential or the signal potential is supplied to the data signal lines from the pre-charging circuit or the data signal line drive circuit at least once.

According to the described arrangement provided with the data signal line drive circuit and the pre-charging circuit, the pre-charge potential or the signal potential is supplied to the data signal lines in the vertical retrace interval at least once. As a result, fluctuations in pixel potential can be made uniform between the positive polarity side and the negative polarity side, thereby suppressing decrease in image quality.

In order to achieve the above object, another image display device of the present invention is characterized by including:

a plurality of pixels arranged in a matrix form;

a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing; and a display section including the plurality of pixels, scanning signal lines and data signal lines, for displaying an image based on a video signal to be inputted to the data signal line drive circuit, wherein the data signal line drive circuit supplies a signal potential to the plurality of data signal lines, samples a video signal to which the vertical retrace interval supply potential is added in the vertical retrace interval, and supplies a signal potential based on the sampling at least once.

According to the described arrangement, in the structure with the data signal line drive circuit but without the pre-charging circuit, the vertical retrace interval supply potential is added to the video signal, and the resulting video signal is sampled to be supplied to the data signal lines at least once. As a result, pixel potential fluctuations can be made uniform between the positive polarity side and the negative polarity side, thereby suppressing decrease in image quality.

In order to achieve the above object, a driving method of the present invention for an image display device, which includes:

a plurality of pixels arranged in a matrix form;

a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal;

a display section including the plurality of pixels, scanning signal lines and data signal lines, for displaying an image based on a video signal to be inputted to the data signal line drive circuit; and a pre-charging circuit for supplying a predetermined pre-charge potential to the plurality of data signal lines according to the pre-charge control signal from an external section in a predetermined interval, is characterized by including the step of:

supplying in a vertical retrace interval, the pre-charge potential or the signal potential to the data signal lines from the pre-charging circuit or the data signal line drive circuit at least once.

According to the above structure provided with the data signal line drive circuit and the pre-charging circuit, the pre-charge potential or the signal potential is supplied to the data signal lines in the vertical retrace interval at least once. As a result, pixel potential fluctuations can be made uniform between the positive polarity side and the negative polarity side, thereby suppressing decrease in image quality.

In order to achieve the above object, another driving method of the present invention for an image display device which includes:

a plurality of pixels arranged in a matrix form; a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal; and a display section including the plurality of pixels, scanning signal lines and data signal lines, for displaying an image based on a video signal to be inputted to the data signal line drive circuit, is characterized by including the step of:

supplying a signal potential to the plurality of data signal lines by the data signal line drive circuit, and sampling a video signal to which vertical retrace interval supply potential is added in the vertical retrace interval, so as to supply a signal potential based on the sampling to the data signal lines at least once.

According to the described arrangement, in the structure with the data signal line drive circuit but without the pre-charging circuit, the vertical retrace interval supply potential is added to the video signal, and the resulting video signal is sampled to be supplied to the data signal lines at least once. As a result, pixel potential fluctuations can be made uniform between the positive polarity side and the negative polarity side, thereby suppressing decrease in image quality.

For a fuller understanding of the nature and advantages of the invention, reference should be made to the ensuing detailed description taken in conjunction with the accompanying drawings.

DESCRIPTION OF THE EMBODIMENTS

First Embodiment

The following descriptions will explain one embodiment of the present invention with reference to drawings.

Figure 2:
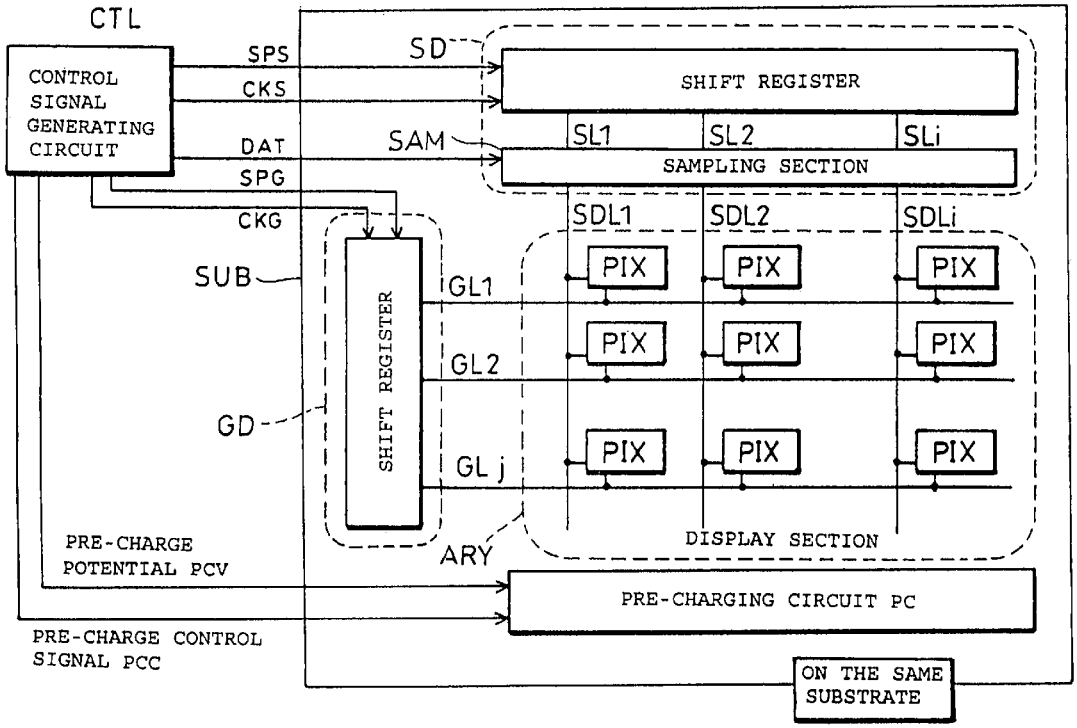
FIG. 2 shows a block diagram of an example structure of the liquid crystal display device in accordance with one embodiment of the present invention.

FIG. 2 is a block diagram illustrating a schematic structure of an image display device in accordance with the present embodiment. As shown in FIG. 2, the image display device includes a data signal line drive circuit SD, a scanning signal line drive circuit GD, a data signal line SDLn ($1 \leqq n \leqq i$), the scanning signal line GLn ($1 \leqq n \leqq j$), pixel PIX, a control signal generating circuit CTL, and a preliminary charging circuit PC. The structure of the pixel PIX section is shown in FIG. 12.

Figure 12:
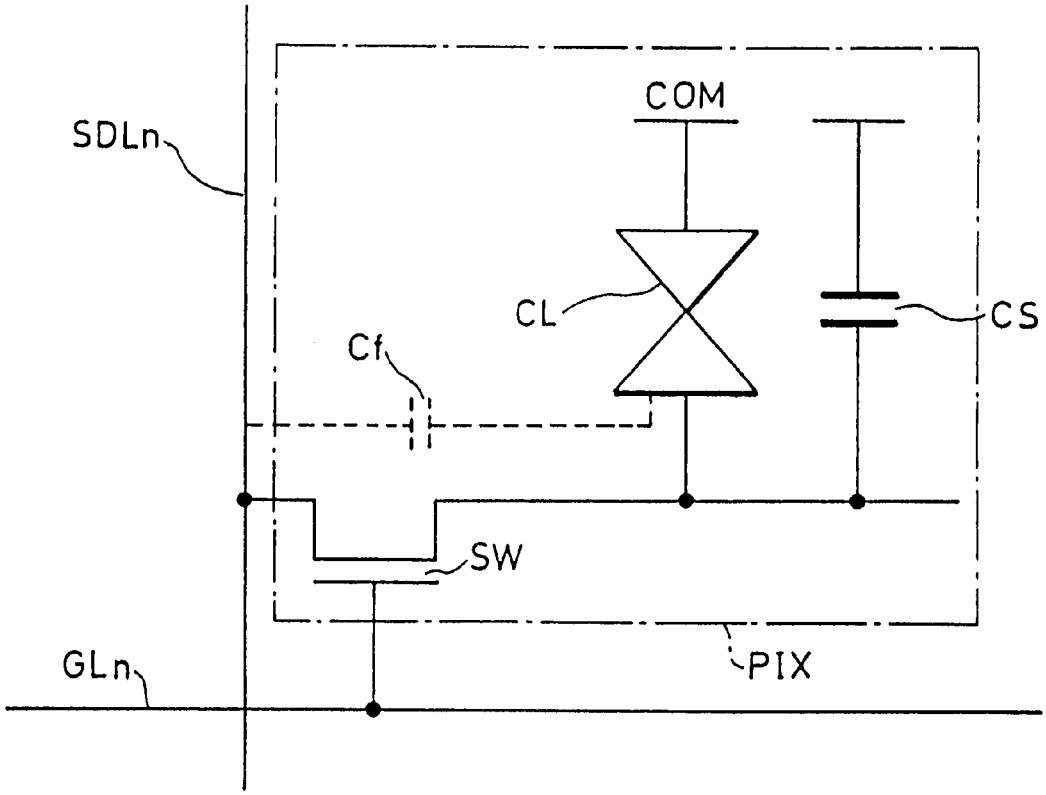
FIG. 12 PRIOR ART
FIG. 12 is an explanatory view showing a schematic structure of pixel.
Figure 13:
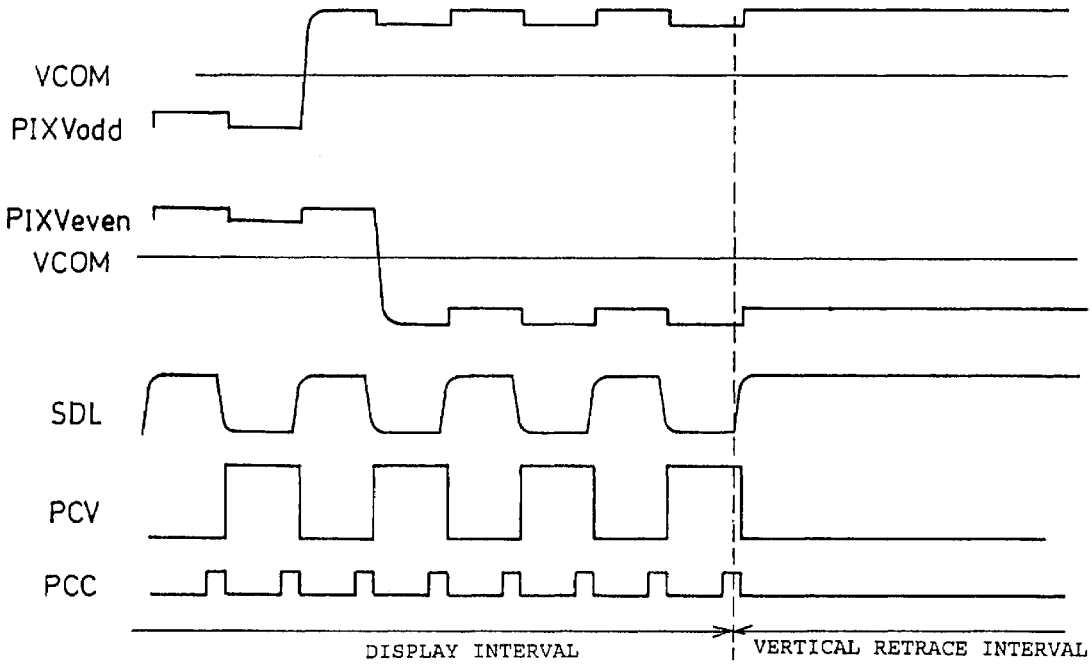
FIG. 13 PRIOR ART
FIG. 13 is an explanatory view showing one example of a drive waveform in the conventional structure of the liquid crystal display device.
Figure 14:
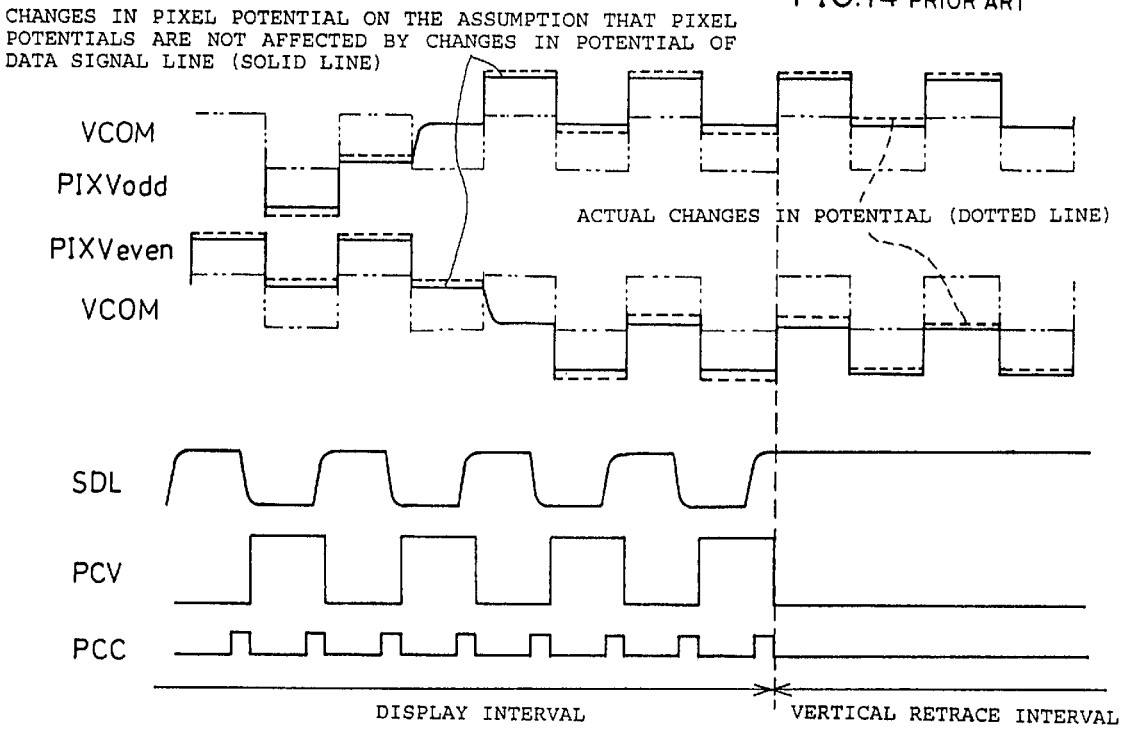
FIG.14 PRIOR ART
FIG. 14 is an explanatory view showing another example of the conventional liquid crystal display device.

As shown in FIG. 12, the pixel PIX includes a switching element SW, a liquid crystal capacity CL and an auxiliary capacity CS. One end of the capacitance which constitutes the pixel PIX is connected to the data signal lines SDL via the switching circuit. The other end of the capacitance is connected to the common electrode called counter electrode COM. Namely, the potential difference between the signal potential written into the pixel PIX via the switching element SW through the data signal lines SDL and the counter potential VCOM is applied to liquid crystal, and the light transmitted through and reflected from the liquid crystal is modulated according to an effective voltage of the potential being applied, thereby realizing various types of displays.

Additionally, the data signal line drive circuit SD, the scanning signal line drive circuit GD, the preliminary charging circuit PC, and each switching element which constitutes each pixel PIX are formed on the same substrate by a polycrystalline silicon thin film transistor manufactured at temperatures not higher than 600° C.

Figure 1:
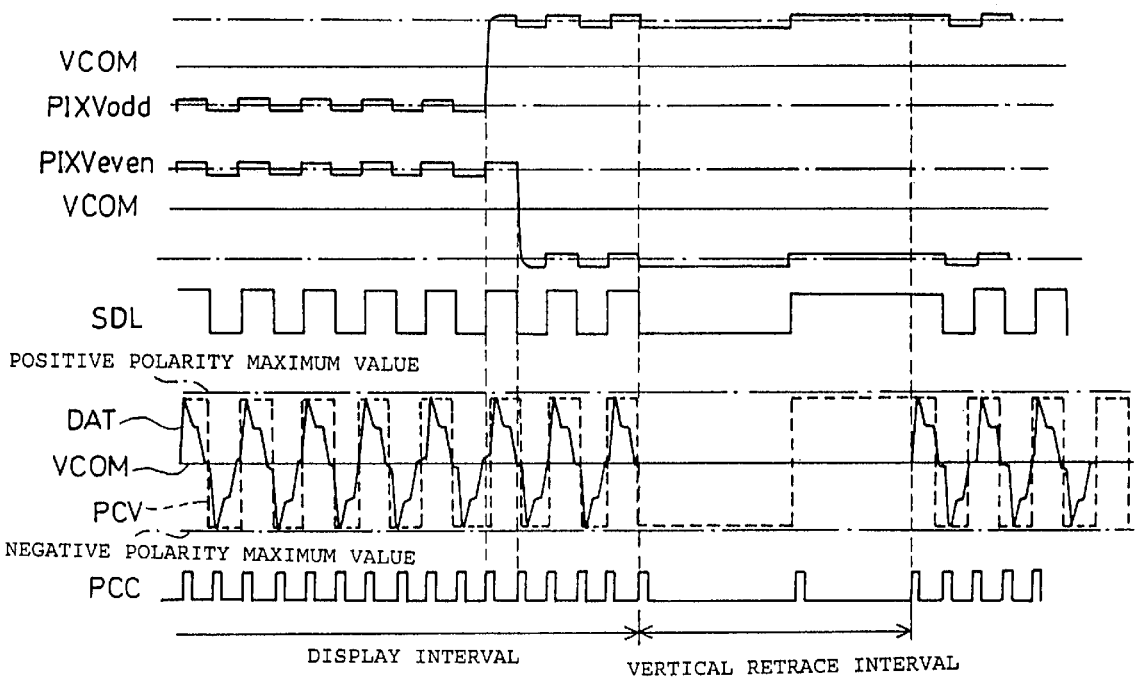
FIG. 1 shows a drive waveform (Example 1) of a liquid crystal display device in accordance with one embodiment of the present invention.

FIG. 1 shows the drive waveform and fluctuations in pixel potential PIXVodd and PIXVeven of the liquid crystal capacitance CL and the subsidiary capacitance CS which constitute the pixel PIX in accordance with one embodiment of the present invention.

For the drive waveform shown in FIG. 1, it is assumed that the same information on video signal with varying polarity is stored in respective pixels in 1 vertical retrace interval. FIG. 1 shows pixel potential PIXVodd of pixels connected to odd-numbered scanning signal line GLodd, and the pixel potential PIXVeven of the pixels connected to even-numbered scanning signal line GLeven, the pre-charge potential PCV, and potentials of the preliminary charging control signal PCC, the data signal lines SDL, the video signal DAT, and the counter potential VCOM.

In the present embodiment, the 1H inverse driving method for switching the polarity of the video signal DAT at every scanning signal line GL is adopted for the driving method of liquid crystal, and the counter potential VCOM applies a DC potential.

In this example, the preliminary charging potential PCV shown in FIG. 1 has the same potential value from the maximum amplitude of the positive polarity of video signal and the maximum amplitude value of the negative polarity of the video signal DAT.

The data signal line drive circuit SD, first, samples video signals DAT of positive polarity into each data signal line SDL by the sampling start signal SPS and the data clock signal CKS.

On the other hand, the scanning signal drive circuit GD sequentially outputs a scanning signal to the scanning signal line GLn ($1 \leqq n \leqq j$) by the scanning start signal SPG and the scanning clock signal CKG, such that the switching element SW of the pixel PIX connected to the scanning signal line GL is selected, thereby writing sampled signal potential to the data signal line. Then, the signal potential of positive polarity is held in this pixel PIX.

Next, upon completing a selection of the scanning signal line GLj by the scanning signal line drive circuit GD, the pixel PIX is separated from the data signal line SDL by the switching element SW. Thereafter, in the data signal line SDL, a signal potential of positive polarity written by the data signal line drive circuit SD is maintained. Then, the pre-charging circuit PC writes in the data signal lines SDL a pre-charge potential PCV of negative polarity, that is identical with the video signal DAT of the negative polarity to be rewritten in the data signal line drive circuit SD.

In the present embodiment, a pre-charge potential PCV that is always in the same polarity as the next writing video signal DAT is inputted to the pre-charging circuit PC at the timing of the pre-charge control signal PCC. Here, the pre-charge potential PCV is set to the maximum value of the video signal DAT.

Then, upon inputting the pre-charge control signal PCC and the pre-charge potential PCV, a pre-charge potential PCV is inputted to each data signal line SDL according to the pre-charge control signal PCC.

Upon completing the pre-charge of the pre-charge potential PCV with respect to the data signal lines SDL, the video signal DAT of negative polarity is sampled in the data signal line SDL. Here, in each data signal line SDL, the potential of pre-charged negative polarity is held, and thus a video signal DATA can be rewritten in the data signal line SDL as desired with ease.

When an attention is given to certain adjacent pixels in the vertical direction, potential states are as indicated by PIXVodd and PIXVeven in FIG. 1. After the video signals DAT are written in pixels PIX at respective timings of scanning signal lines GL, the potential of positive polarity is maintained in PIXVodd, and the potential of negative polarity is held in PIXVeven. Rising parts of the waveform of PIXVodd indicate portions where the signal potentials of positive polarity are written into pixels connected to the scanning signal line GLn, and the falling portions of the waveform PIXVeven indicate portions where the signal potentials of negative polarity are written in pixels PIX connected to the scanning signal line GLn+1 1H after the signal is written into the pixel connected to GLn.

Upon stopping the switching element SW by the scanning signal, respective pixels PIX are separated from the data signal line. To respective one ends of the liquid crystal capacity CL and the auxiliary capacity CS which constitute each pixel PIX, a counter potential VCOM is applied, and one of the pixels is connected to the switching element SW, and thus the pixel PIX is in the floating state. Further, a parasitic capacity is formed between the pixel PIX and the data signal line SDL, and the both are in the charge-coupled state.

In the data signal line SDL, pre-charge potential PCV and a signal polarity obtained by sampling the video signal DAT of different polarities are written alternately at every 1H. Therefore, the potential of the pixel PIX that is charge-coupled with the data signal line SDL is subjected to a change in potential every time the potential of the data signal line SDL is changed as indicated by PIXVodd and PIXVeven in FIG. 1.

In the case where both pixels are always affected by the data signal line SDL at the same potential, for the display, by adjusting the counter potential VCOM, decrease in quality due to changes in pixel potential can be suppressed. During the vertical retrace interval of the video signal, as explained in the section "Prior Art", in order to maintain the potential of the data signal line SDL constant, uneven fluctuations are applied to respective polarities of pixels PIX, and thus the adjustment of counter potential VCOM does not offer satisfactory solution for the decrease in image quality.

Upon completing writing operation into pixels for one screen by the pre-charge potential control signal PCC and the pre-charge potential PCV, as shown in FIG. 1, the pre-charge potential PCV of both polarities are written once each to the data signal line SDL in the vertical retrace interval of the video signal by the function of the pre-charge control signal PCC shown in FIG. 1.

In this case, the pixel potential fluctuations of the pixel PIX can be maintained uniform by applying the pre-charge potential PCV of a potential of each polarity video signal to the data signal line SDL in the vertical retrace interval as indicated by PIXVodd and PIXVeven in FIG. 1. Here, it is desirable that the effective voltage value of each polarity level potential supplied to the data signal line by the pre-charge control signal PCC in the vertical retrace interval is equivalent.

Here, a definition of the effective voltage value is given as a value obtained by dividing an time integral of the square of the voltage by an integral interval (time), and taking a square root of the resulting value. For example, with a given function of v=f(t) wherein an arbitrary voltage v varies with time t, with an interval of a time t from t1 to t2, and the time difference T=(t2−t1), the effective voltage Vrms can be indicated by the following formula:

$$Vrms = \sqrt{\frac{\int_{t1}^{t2} f^2(t)\,dt}{T}}$$

$$T = (t2 - t1)$$

Assumed the function f(t) represents a rectangular waveform with an amplitude of 2V and a cycle of T. Then, if respective time periods for positive polarity region and negative polarity region with respect to the central voltage value V of the waveform are both T/2, the effective voltage value for the positive polarity region would be equivalent to the effective voltage value for the negative polarity region. Namely, in the case where the horizontal axis indicates time and the vertical axis indicates voltage values, a region surrounded by the difference between the central voltage value of the waveform and the voltage waveform, and the time period for the region indicates an effective voltage value of a potential for a region of each polarity.

Equivalent effective voltage values for the positive polarity region and the negative polarity region desirably indicates the state where the difference in effective voltage values for respective polarity regions is zero. However, this difference in effective voltage values for respective polarity regions does not need to be strictly zero as long as the difference would not be a problem for a display of an image in practical level. In order words, as long as the condition of the difference in effective voltage values being smaller than the displayable gray scale interval holds, the effects of the present invention can be achieved.

For example, in the case of 256 gray scale display of a rectangular waveform with a difference between the positive polarity maximum amplitude value and the maximum negative polarity amplitude value of 10 V, a voltage difference for one polarity is 5V. In the case of 256 gray scale display, a potential difference for one scale is around 20 mV. Here, explanations will be given through the case of the vertical retrace interval (around 20H) for NTSC signal as a typical example for a video signal. In this case, when the ratio of the time period in which a voltage value of one polarity holds to the time period in which a voltage value of the other polarity holds is 1:1, the difference in effective voltage is 0. However, as long as the ratio of the time periods for respective polarities is no larger than 13:7, a potential difference of one gray scale would not be greater than 20 mV, and a problem would not arise for gray scale display in practical level. This, however, is on the assumption that the voltage differences for respective polarities with respect to the central voltage of the waveform are equivalent. Therefore, in the case where the voltage difference for one polarity is greater than the other with respect to the central voltage, the ratio of time periods for respective polarities would differ from the above range. It should be also noted here that the above-explained range would differ also depending on the pixel capacitor or the parasitic capacitor, and thus the range of the ratio for the respective polarities of the present invention is not limited to the above-range of from 1:1 to 13:7.

Figure 3:
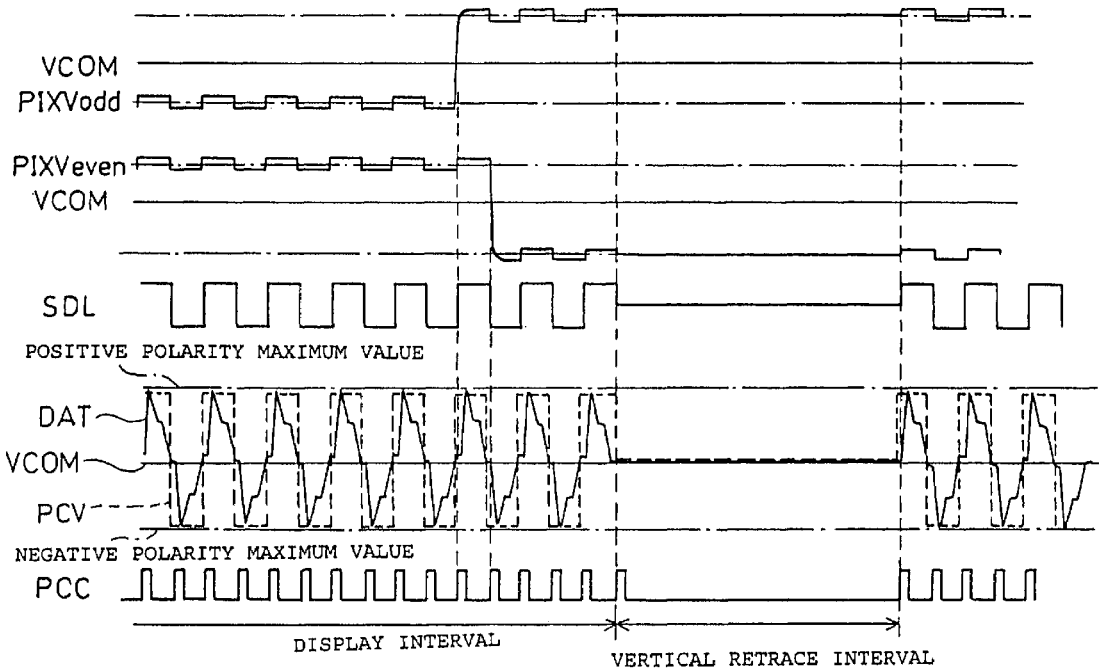
FIG. 3 is an explanatory view showing a drive waveform (Example 2) of a liquid crystal display device in accordance with one embodiment of the present invention.

As shown in FIG. 3, the pre-charge potential PCV set to be a potential equivalent from both the positive polarity maximum amplitude value and the negative polarity maximum amplitude value of the video signal is applied to the data signal line SDL in the vertical retrace interval. Namely, by setting the central value (video center) of dynamic range of the video signal DAT supplied to the data signal line drive circuit SD of the liquid crystal display device to the pre-charge potential PCV during the vertical retrace interval, uniform fluctuations in pixel potential can be achieved.

Second Embodiment

The following descriptions will describe another embodiment of the present invention in reference to figures.

An image display device of the present embodiment has the same structure as that of the above-explained image display device of the first embodiment except that a pre-charge potential PCV has an AC potential in synchronization with 1 horizontal scan period (1H) of a video signal. A drive waveform of this embodiment is shown in FIG. 4.

Figure 4:
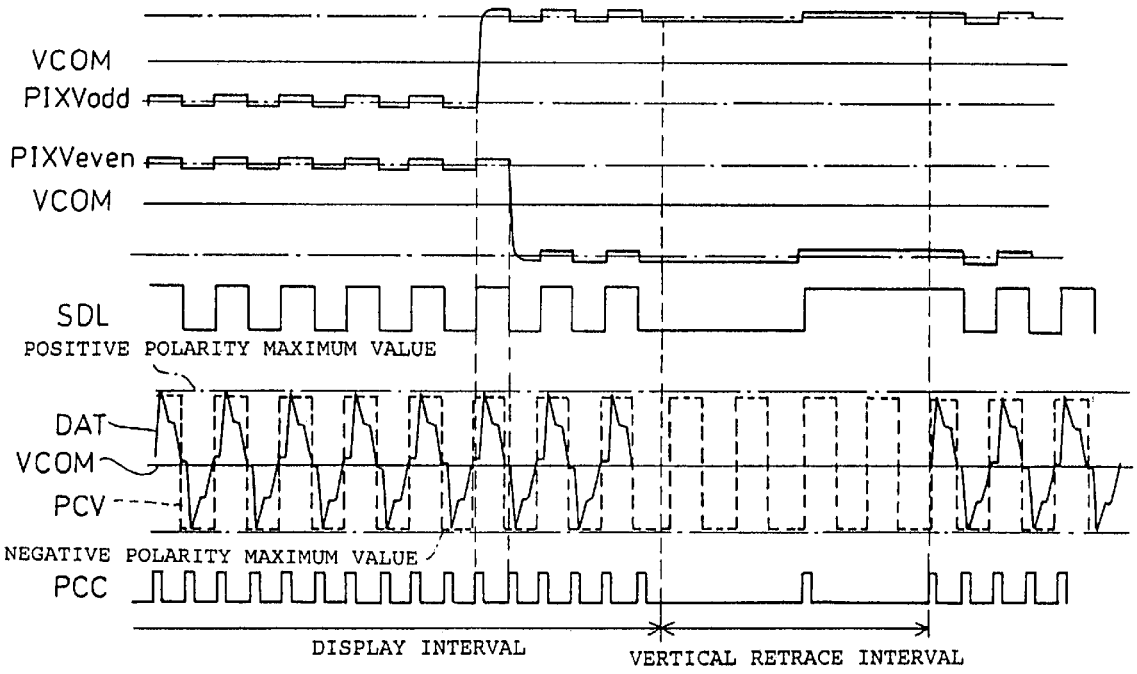
FIG. 4 is an explanatory view showing a drive waveform of a liquid crystal display device in accordance with another embodiment of the present invention.

The drive waveform shown in FIG. 4 only differs from that of the first embodiment only in AC period of the pre-charge potential PCV and a timing of the pre-charge control signal PCC, and a driving method and functions of members which constitute the image display device are the same as those of the first embodiment.

The structure of the present embodiment wherein a signal of a predetermined cycle in synchronization with 1 horizontal scan period (1H) is adopted for a signal of one kind, is preferable over the structure wherein plurality of cycles are adopted for a signal of one kind as the former structure permits a simplified manufacturing process.

As shown in FIG. 4, signal potentials based on the sampling of the video signal DAT are written in pixels for one screen using the pre-charge potential PCV having an AC potential in synchronization with the pre-charge control signal PCC for 1H period. Upon completing this writing operation, with the function of the pre-charge control signal PCC shown in FIG. 4, in the vertical retrace interval of the video signal DAT, a pre-charge potential PCV having potentials of respective polarities for AC driving liquid crystals is pre-charged to the data signal line SDL once for each polarity.

In this case, the pixel potential fluctuations of the pixel PIX can be maintained uniform by applying the pre-charge potential PCV of a potential of each polarity video signal to the data signal line SDL in the vertical retrace interval as indicated by PIXVodd and PIXVeven in FIG. 4. Here, it is desirable that the effective voltage value of each polarity level potential supplied to the data signal line SDL using the pre-charge control signal PCC in the vertical retrace interval is equivalent. Here, the definition of the effective voltage value is given as a value obtained by dividing a time integral of the square of the voltage by an integral interval (time), and taking a square root of the resulting value. For example, with a given function of v=f(t) wherein an arbitrary voltage v varies with time t, with an interval of a time t from t1 to t2, and the time difference T=(t2−t1), the effective voltage Vrms can be defined by the following formula:

$$Vrms = \sqrt{\frac{\int_{t1}^{t2} f^2(t)\,dt}{T}}$$

$$T = (t2 - t1)$$

Assumed the function f (t) represents a rectangular waveform with an amplitude of 2V and a cycle of T. Then, if respective time periods for positive polarity region and negative polarity region with respect to the central voltage value V of the waveform are both T/2, the effective voltage value for the positive polarity region would be equivalent to the effective voltage value for the negative polarity region. Namely, in the case where the horizontal axis indicates time and the vertical axis indicates voltage values, a region surrounded by the difference between the central voltage value of the waveform and the voltage waveform, and the time period for the region indicates an effective voltage value of a potential for a region of each polarity.

Equivalent effective voltage values for the positive polarity region and the negative polarity region desirably indicates the state where the difference in effective voltage values for respective polarity regions is zero. However, this difference in effective voltage values for respective polarity regions does not need to be strictly zero as long as the difference would not be a problem for a display of an image in practical level. In order words, as long as the condition of the difference in effective voltage values being smaller than the displayable gray scale interval holds, the effects of the present invention can be achieved.

For example, in the case of 256 gray scale display of a rectangular waveform with a difference between the positive polarity maximum amplitude value and the maximum negative polarity amplitude value of 10 V, a voltage difference for one polarity is 5V. In the case of 256 gray scale display, a potential difference for one scale is around 20 mV. Here, explanations will be given through the case of the vertical retrace interval (around 20H) for NTSC signal as a typical example for a video signal. In this case, when the ratio of the time period in which a voltage value of one polarity holds to the time period in which a voltage value of the other polarity holds is 1:1, the difference in effective voltage is 0. However, as long as the ratio of the time periods for respective polarities is no larger than 13:7, a potential difference of one gray scale would not be greater than 20 mV, and a problem would not arise for gray scale display in practical level. This, however, is on the assumption that the voltage differences for respective polarities with respect to the central voltage of the waveform are equivalent. Therefore, in the case where the voltage difference for one polarity is greater than the other with respect to the central voltage, the ratio of time periods for respective polarities would differ from the above range. It should be also noted here that the above-explained range would differ also depending on the pixel capacitor or the parasitic capacitor, and thus the range of the ratio for the respective polarities of the present invention is not limited to the above-range of from 1:1 to 13:7.

Third Embodiment

The following descriptions will describe still another embodiment of the present invention in reference to figures.

The image display device of the present embodiment has the same basic structure as the first embodiment except for the following.

That is in the present embodiment, the pre-charge potential PCV in the vertical retrace interval is an AC potential of not less than 50 percent of the maximum value of the video signal of positive polarity, and not less than 50 percent of the maximum value of the video signal of negative polarity. The waveforms of respective members are as shown in FIG. 5.

Figure 5:
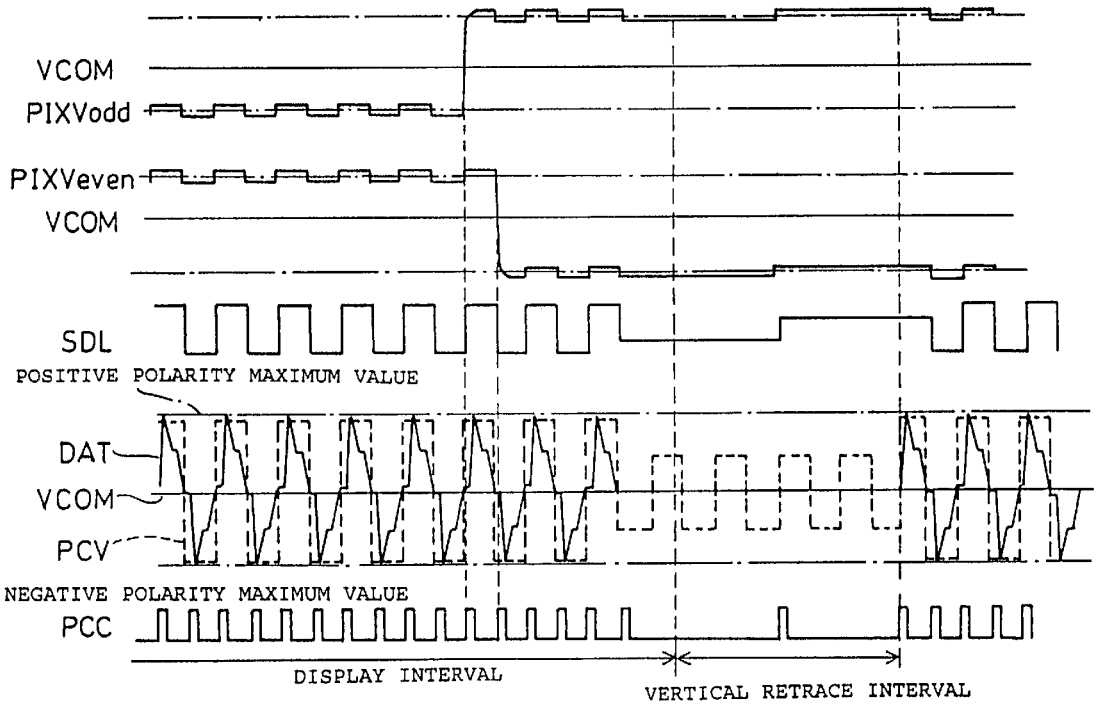
FIG. 5 is an explanatory view showing a drive waveform in accordance with still another embodiment of the present invention.

The drive waveforms shown in FIG. 5 differ from those of the second embodiment only in the pre-charge potential PCV in the vertical retrace interval. The present embodiment has the same arrangement as the second embodiment in the driving method and functions of the members.

According to the arrangement of the present embodiment, a suitable potential of the pre-charge potential PCV during the vertical retrace interval can be selected for the level of pixel potential fluctuations. As shown in FIG. 5, for the pre-charge potential PCV having a potential of each polarity for driving liquid crystals with an AC voltage, a pre-charge potential PCV of not less than 50 percent of the maximum value of the video signal in positive polarity, and not less than 50 percent of the maximum value of the video signal in negative polarity is selected, and upon completing a writing operation of the signal potential as a result of sampling the video signal DAT into the pixels of one screen, with the function of the pre-charge control signal PCC shown in FIG. 5, the video signal line SDL is pre-charged with the pre-charge potential PCV once for each polarity.

In this case, as indicated by the pixel PIXVodd and the potential PIXeven in the vertical retrace interval shown in FIG. 5, the pixel potential fluctuations of the pixel PIX can be maintained uniform by applying the pre-charge potential PCV of a potential of each polarity video signal to the data signal line SDL. Here, it is desirable that the effective voltage value of each polarity level potential supplied to the data signal line by the pre-charge control signal PCC in the vertical retrace interval is equivalent. Here, a definition of the effective voltage value is given as a value obtained by dividing an time integral of the square of the voltage by an integral interval (time), and taking a square root of the resulting value. For example, with a given function of v=f(t) wherein an arbitrary voltage v varies with time t, with an interval of a time t from t1 to t2, and the time difference T=(t2−t1), the effective voltage Vrms can be indicated by the following formula:

$$Vrms = \sqrt{\frac{\int_{t1}^{t2} f^2(t)\,dt}{T}}$$

$$T = (t2 - t1)$$

Assumed the function f(t) represents a rectangular waveform with an amplitude of 2V and a cycle of T. Then, if respective time periods for positive polarity region and negative polarity region with respect to the central voltage value V of the waveform are both T/2, the effective voltage value for the positive polarity region would be equivalent to the effective voltage value for the negative polarity region. Namely, in the case where the horizontal axis indicates time and the vertical axis indicates voltage values, a region surrounded by the difference between the central voltage value of the waveform and the voltage waveform, and the time period for the region indicates an effective voltage value of a potential for a region of each polarity.

Equivalent effective voltage values for the positive polarity region and the negative polarity region desirably indicates the state where the difference in effective voltage values for respective polarity regions is zero. However, this difference in effective voltage values for respective polarity regions does not need to be strictly zero as long as the difference would not be a problem for a display of an image in practical level. In order words, as long as the condition of the difference in effective voltage values being smaller than the displayable gray scale interval holds, the effects of the present invention can be achieved.

For example, in the case of 256 gray scale display of a rectangular waveform with a difference between the positive polarity maximum amplitude value and the maximum negative polarity amplitude value of 10 V, a voltage difference for one polarity is 5V. In the case of 256 gray scale display, a potential difference for one scale is around 20 mV. Here, explanations will be given through the case of the vertical retrace interval (around 20H) for NTSC signal as a typical example for a video signal. In this case, when the ratio of the time period in which a voltage value of one polarity holds to the time period in which a voltage value of the other polarity holds is 1:1, the difference in effective voltage is 0. However, as long as the ratio of the time periods for respective polarities is no larger than 13:7, a potential difference of one gray scale would not be greater than 20 mV, and a problem would not arise for gray scale display in practical level. This, however, is on the assumption that the voltage differences for respective polarities with respect to the central voltage of the waveform are equivalent. Therefore, in the case where the voltage difference for one polarity is greater than the other with respect to the central voltage, the ratio of time periods for respective polarities would differ from the above range. It should be also noted here that the above-explained range would differ also depending on the pixel capacitor or the parasitic capacitor, and thus the range of the ratio for the respective polarities of the present invention is not limited to the above-range of from 1:1 to 13:7.

Fourth Embodiment

The following descriptions will explain still another embodiment of the present invention with reference to drawings.

Figure 6:
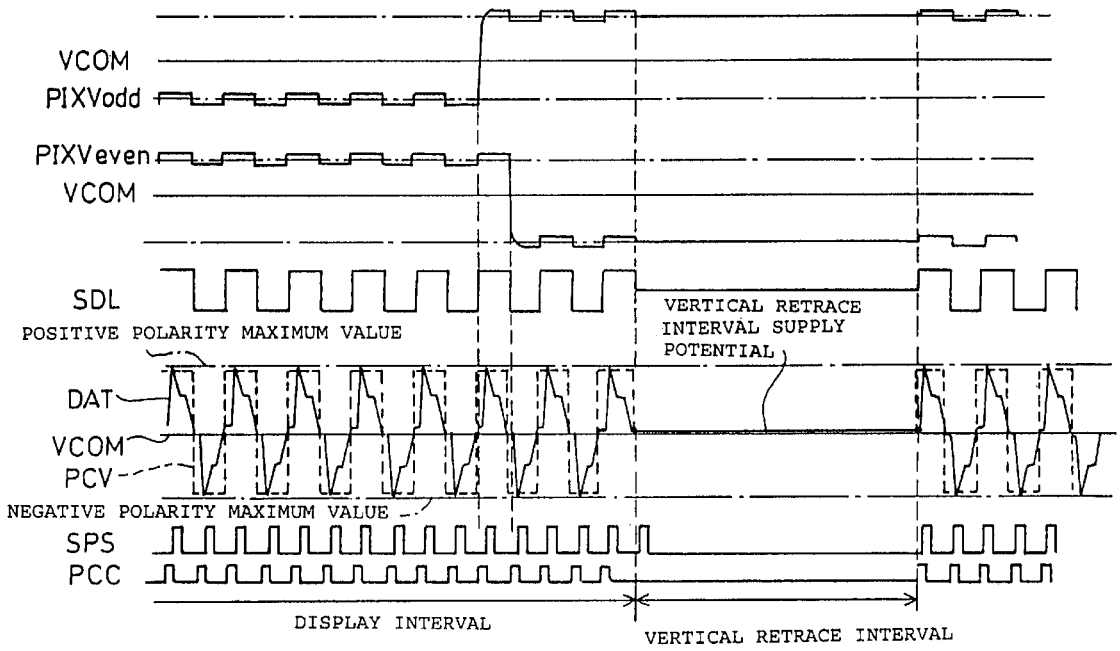
FIG. 6 is an explanatory view showing a drive waveform in accordance with still another embodiment of the present invention.

The basic structure of the liquid crystal device of the present embodiment is the same as that of the first embodiment. The derive waveform of the present embodiment is shown in FIG. 6. The driving method of the present embodiment is based on the driving method of the first embodiment, and is arranged as follows.

A vertical retrace interval supply potential set to a potential equivalent from both the positive polarity maximum amplitude value and the negative polarity maximum amplitude value of the video signal DAT is added to a video signal DATA in the vertical retrace interval of the video signal DAT, and the data signal line drive circuit SD samples the resulting signal DAT, and the signal potentials of the video signal DAT as a result of sampling are supplied to the data signal line SDL at least once. As a result, the pre-charging circuit PC and the scanning signal line drive circuit GD are stopped operating during the vertical retrace interval, and the data signal line drive circuit SD is activated at least once to supply signal potentials to the data signal line SDL using data sampling start signal SPS.

As explained earlier in the first embodiment, the data signal line drive circuit SD has a function of sampling and supplying the video signal DAT to each data signal line SDL using the data sampling start signal SPS and the data clock signal CKS received from the control signal generating circuit CTL shown in FIG. 2. With the described function of the data signal line drive circuit SD, pixel potential fluctuations can be suppressed without the pre-charging circuit PC.

As shown in FIG. 6, upon completing writing of video signals into pixels for one screen, based on the sampling start signal SPS as applied in the vertical retrace interval, a vertical retrace interval supply potential that has a potential value equivalent from the positive polarity maximum amplitude value and the negative polarity maximum amplitude value of the video signal is added to the video signal DAT in the vertical retrace interval, and the potentials of the resulting video signal DAT based on the sampling are supplied to the data signal line SDL.

In this case, as indicated by PIXVodd and PIXVeven shown in FIG. 6, fluctuations in potential of pixels can be maintained uniform by sampling the video signal DAT to which a potential which is equivalent from both the positive maximum amplitude value and the negative maximum amplitude value of the video signal DAT is added in the vertical retrace interval as a vertical retrace interval supply potential, and supplying signal potentials to the data signal line SDL based on the sampling.

Figure 7:
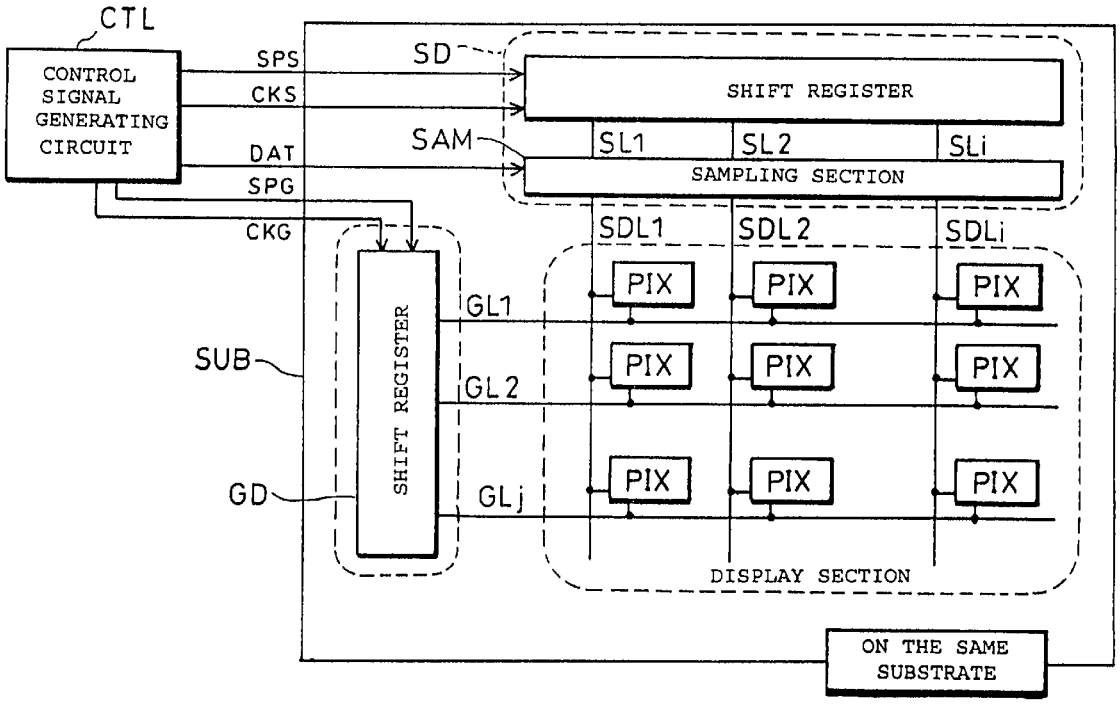
FIG. 7 is a block diagram showing a schematic structure of the liquid crystal display device in accordance with still another embodiment of the present invention.

With the forgoing structure of the driving method of the present embodiment, the effects of the present invention can be achieved without a pre-charging circuit like the case of FIG. 7.

Fifth Embodiment

The following descriptions will explain still another embodiment of the present invention with reference to drawings.

The driving method of the present embodiment is applied to a liquid crystal display device without a pre-charging circuit PC.

FIG. 7 is a block diagram showing a schematic structure of the liquid crystal display device of the present embodiment. The data signal line drive circuit SD, the scanning signal line drive circuit GD, and the pixels PIX of the present embodiment are the same as those of the first embodiment. The drive waveform of the present embodiment is shown in FIG. 8 which is almost the same as the drive waveform shown in FIG. 4 except for the following.

In the case of FIG. 4, in the vertical retrace interval, the pre-charge potential PCV is inverted, and in the meantime, the pre-charge control signal PCC is applied to the data signal line SDL so as to invert the polarity of signal potentials applied to the data signal line SDL so as to maintain pixel potential fluctuations uniform.

Figure 8:
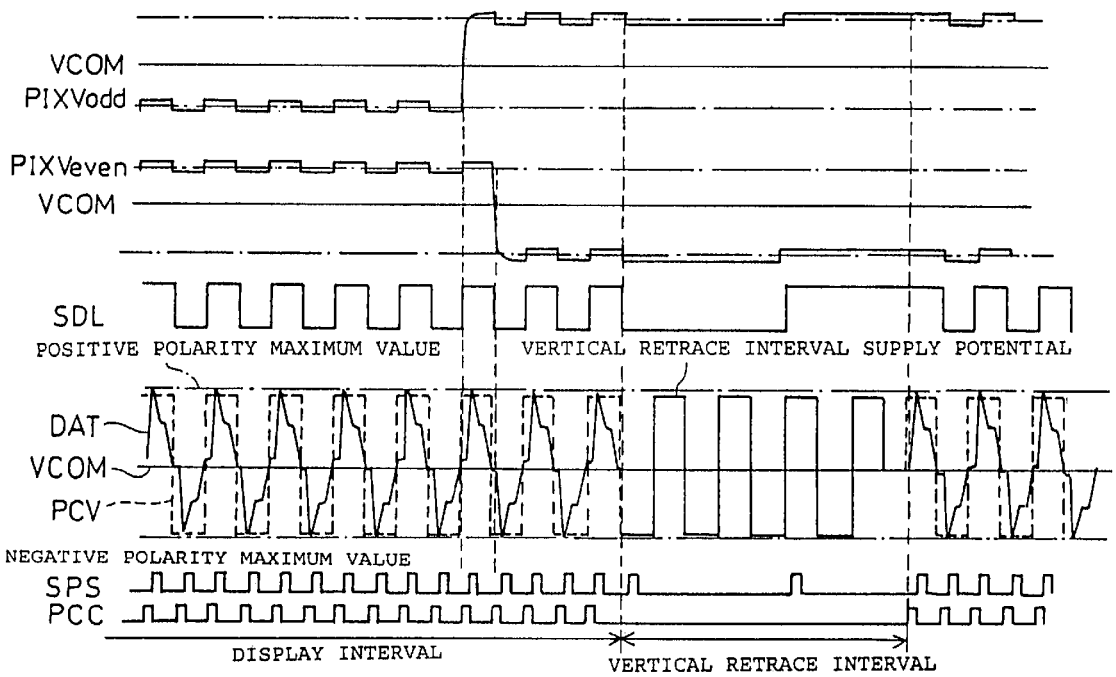
FIG. 8 is an explanatory view showing one example of a drive wave system of the liquid crystal display device shown in FIG. 7 of the present invention.

In contrast, in the cases of FIGS. 7 and 8 without the pre-charging circuit PC, in the vertical retrace interval, the positive polarity maximum potential and the negative polarity maximum potential of the video signal DAT are added to the video signal DAT as the vertical retrace interval supply potential, and the data sampling start signal is supplied to the data signal line drive circuit SD in the vertical retrace interval so as to vary the polarities of the signal potentials to be applied to the data signal line SDL in the vertical retrace interval, thereby maintaining the pixel potential fluctuations uniform as indicated by variable waveform of pixel potentials PIXVodd and PIXVeven shown in FIG. 8.

The forgoing driving method of the present embodiment for sampling the potential added to the video signal DAT in the vertical retrace interval as the vertical retrace interval supply potential, and applying signal potentials based on the sampling to the data signal line SDL is applicable also for the driving of the image display device provided with the pre-charging circuit PC shown in FIG. 2.

Sixth Embodiment

The following descriptions will explain still another embodiment of the present invention with reference to drawings.

FIG. 7 is a block diagram showing a schematic structure of the liquid crystal display device in accordance with the present embodiment. As shown in FIG. 7, the data signal line drive circuit SD, the scanning signal line drive circuit GD, and the pixels PIX of the present embodiment are the same as those of the first embodiment. The drive waveform of the present embodiment is shown in FIG. 9 which is almost the same as the drive waveform shown in FIG. 5 except for the following.

In the driving method shown in FIG. 5, the pre-charge potential PCV of not less than 50 percent of the maximum value of the video signal DAT in positive polarity, and not less than 50 percent of the maximum value of the video signal DAT in negative polarity, and the pre-charge control signal PCC are added to the pre-charging circuit PC so as to invert polarities of signal potentials to be supplied to the data signal line SDL, thereby maintaining fluctuations in pixel potential uniform.

Figure 9:
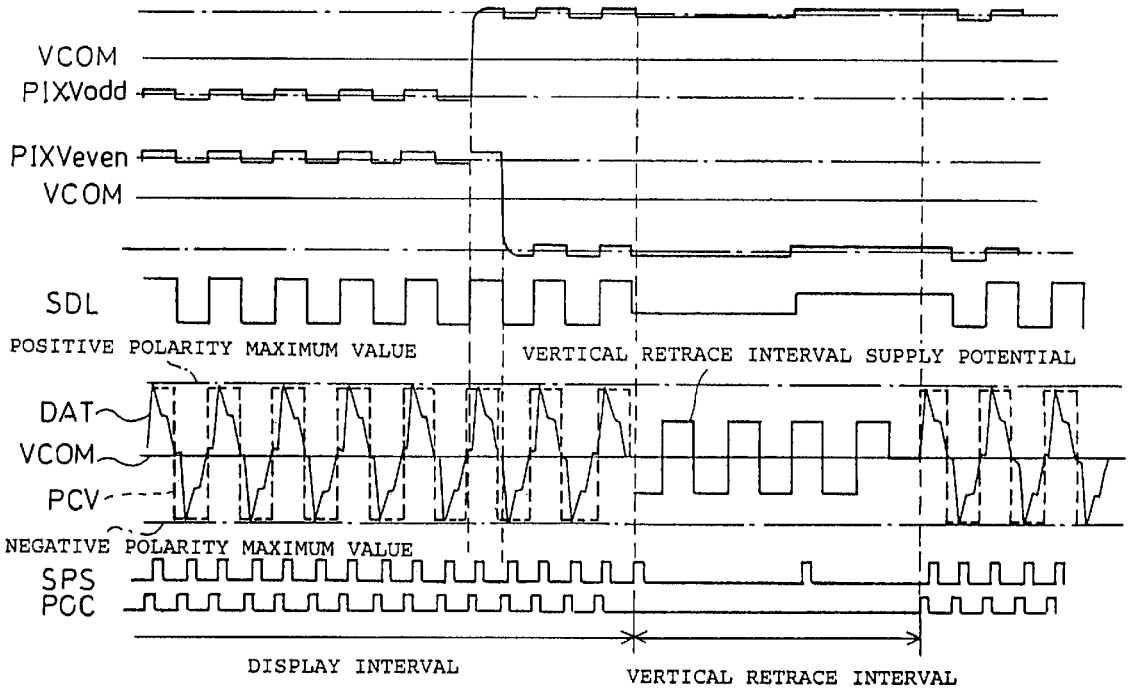
FIG. 9 is an explanatory view showing a drive waveform of the liquid crystal display device in accordance with still another embodiment of the present invention.

In contrast, in the cases of FIGS. 7 and 9 without the pre-charging circuit PC, in the vertical retrace interval, AC potential of not less than 50 percent of the maximum value of the video signal DAT in positive polarity, and not less than 50 percent of the maximum value of the video signal DAT in negative polarity are added to the video signal DAT, and the data sampling start signal SPS is added to the data signal lien drive circuit SD in the vertical retrace interval, so as to vary polarities of signal potentials to be applied to the data signal line SDL in the vertical retrace interval, thereby maintaining the pixel potential fluctuations uniform as indicated by variable waveform of pixel potential PIXVodd and PIXVeven of the pixel potentials shown in FIG. 9.

The forgoing driving method of the present embodiment for sampling the potential added to the video signal DAT in the vertical retrace interval as the vertical retrace interval supply potential, and applying signal potentials based on the sampling to the data signal line SDL is applicable also for the driving of the image display device provided with the pre-charging circuit PC shown in FIG. 2.

Seventh Embodiment

The following descriptions will explain still another embodiment of the present invention with reference to drawings.

Figure 10:
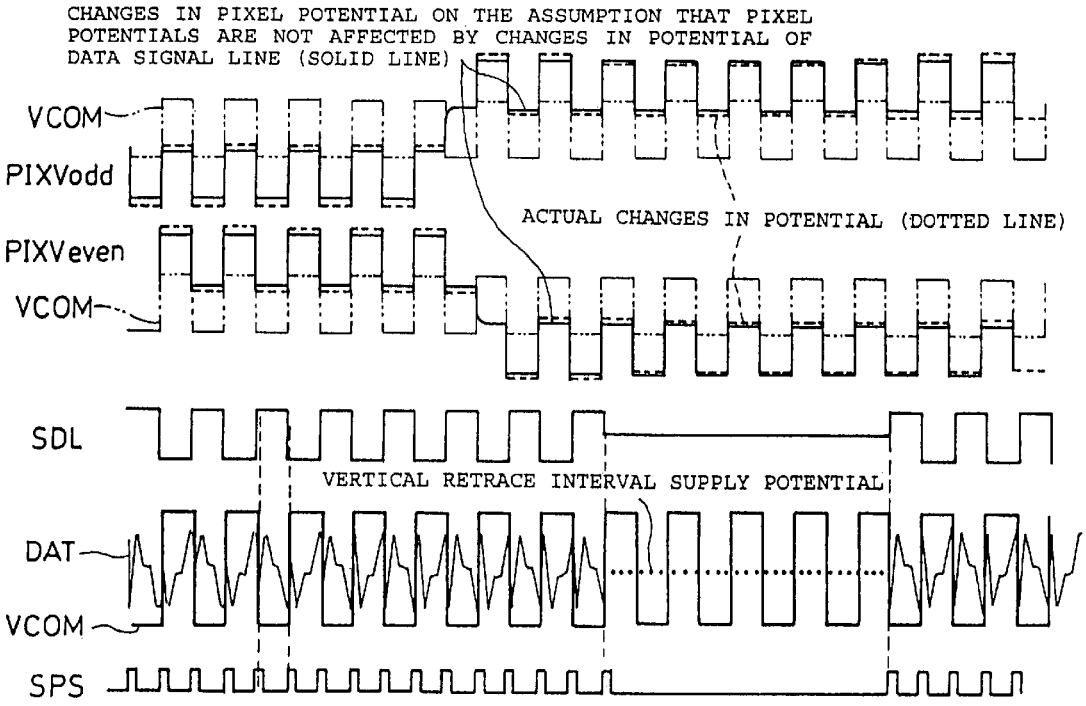
FIG. 10 is an explanatory view showing a drive waveform of a liquid crystal display device in accordance with still another embodiment of the present invention.
Figure 11:
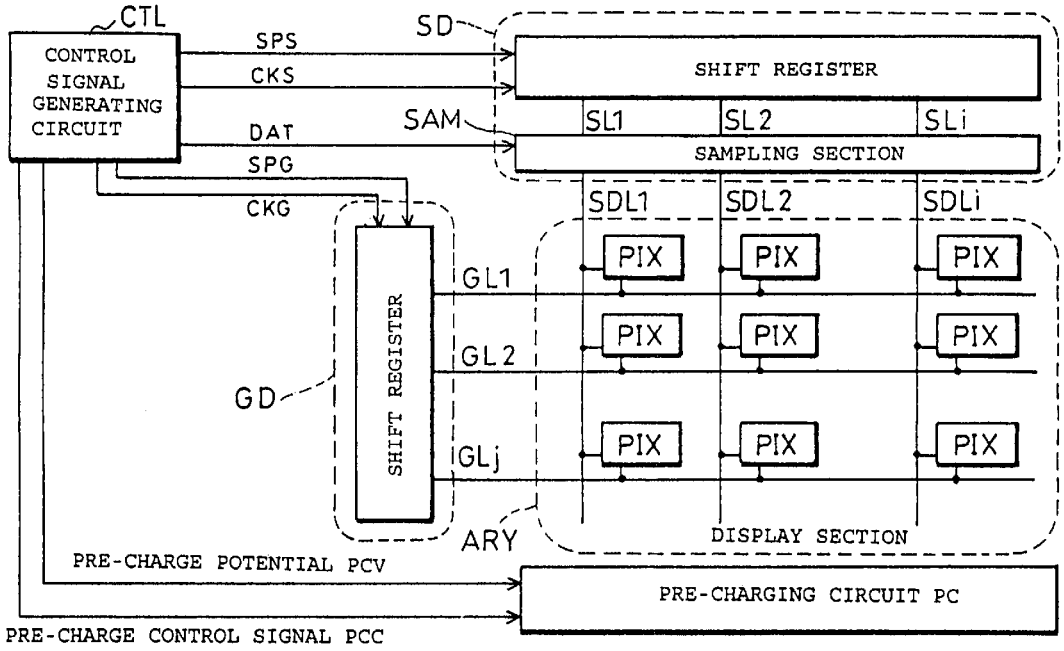
FIG. 11 PRIOR ART
FIG. 11 is a block diagram showing a schematic structure of a conventional liquid crystal display device.

In the present embodiment, explanations will be given through the case of adopting an AC potential for the counter potential VCOM. The liquid crystal display device of the present embodiment has a drive waveform shown in FIG. 10. In the case of FIG. 10, the video signal DAT to which a potential equivalent from both the positive polarity maximum amplitude value of the video signal and the negative polarity maximum amplitude value of the video signal is added in the vertical retrace interval is sampled, and signal potentials based on the sampling are added to the data signal lien SDL.

In this case, as indicated by PIXVodd and PIXVeven shown in FIG. 10, fluctuations in potential of pixels can be maintained uniform by sampling the video signal DAT to which a potential which is equivalent from both the positive maximum amplitude value and the negative maximum amplitude value of the video signal DAT is added in the vertical retrace interval as a vertical retrace interval supply potential, and supplying signal potentials to the data signal line SDL based on the sampling.

The forgoing driving method of the present embodiment for sampling the potential added to the video signal DAT in the vertical retrace interval as the vertical retrace interval supply potential, and applying signal potentials based on the sampling to the data signal line SDL is applicable to both the case provided with the pre-charging circuit PC (FIG. 2) and the case without the pre-charging circuit PC (FIG. 7).

[Structure of Image Display Device]

The structure of the image display device adopted in the first through seventh embodiments of the present invention will be explained in reference to figures. FIG. 2 is a block diagram showing a schematic structure of the image display device of the present invention. As shown in FIG. 2, the image display device includes pixels PIX, the data signal line drive circuit SD, the scanning signal line drive circuit GD and the pre-charging circuit PC which are formed on the same substrate SUB (driver monolithic structure), and is driven by signals from the control signal generating circuit CTL.

The pre-charging circuit PC, the data signal line drive circuit SD and the scanning signal line drive circuit GD are formed substantially to the length of a screen (display region).

According to this structure of forming pixels PIX, the data signal line drive circuit SD, the scanning signal line drive circuit GD and the pre-charging circuit PC on the same substrate SUB, the manufacturing cost and the mounting cost of the drive circuits can be reduced, and moreover an improved reliability can be achieved.

Figure 15:
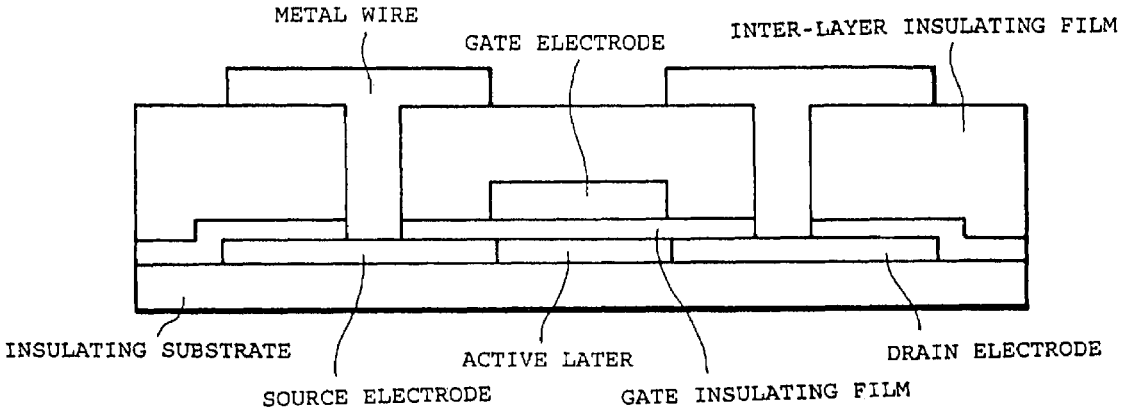
FIG. 15 is an explanatory view showing a schematic structure of a polycrystalline thin film transistor which constitutes a liquid crystal display device of the present invention.
Figure 16A:
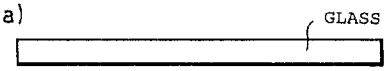
FIGS. 16(*a*) through 16(*k*) are explanatory views showing the process of manufacturing polycrystalline thin film transistor.
Figure 16B:
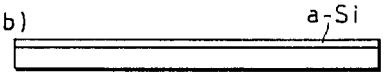
Figure 16C:
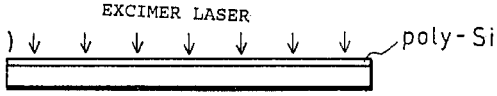
Figure 16D:
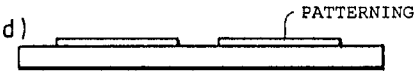
Figure 16E:
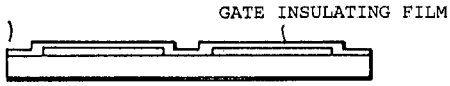
Figure 16F:
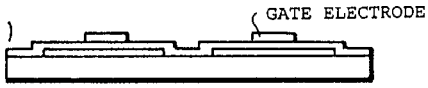
Figure 16G:
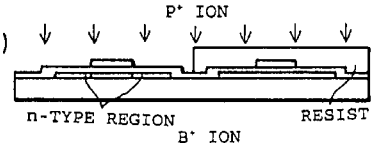
Figure 16H:
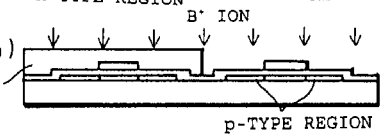
Figure 16I:
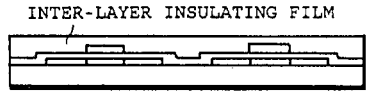
Figure 16J:
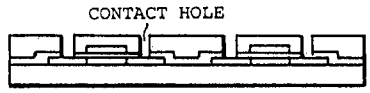
Figure 16K:
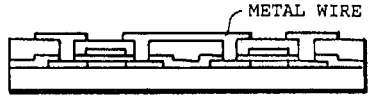

FIG. 15 shows a structure of a polycrystalline silicon thin film transistor which constitutes the image display device of the present invention. As shown in FIG. 15, the polycrystalline silicon thin film has a pure stagger structure (top gate structure); however, the present invention is not limited to this structure, and other structure such as inverse stagger structure, etc., may be adopted.

By adopting the polycrystalline silicon thin film transistor, the pre-charging circuit PC, the scanning signal line drive circuit GD and the data signal line drive circuit SD can be formed on the same substrate SUB in the same manufacturing process.

FIGS. 16(*a*) through 16(*k*) show the manufacturing processes of the polycrystalline silicon thin film transistor. The following will briefly explain the manufacturing process in the case of forming the polycrystalline silicon thin film transistor at temperatures not higher than around 600° C. FIGS. 16(*a*) through 16(*k*) show cross-sections in respective processes.

As shown in FIG. 16(*a*), first, an insulating substrate made of glass, etc., is forme with ease. Then, as shown in FIG. 16(*b*), an amorphous silicon thin film (a-Si), etc., is formed on the substrate. Next, as shown in FIG. 16(*c*), an excimer laser is projected on the film formed on the substrate so as to form the polycrystalline silicon thin film (poly-Si). Next, as shown in Figure (d), the polycrystalline silicon thin film is patterned in a shape as desired. Then, as shown in Figure (f), the gate electrode of the thin film transistor is formed. Further, as shown in FIG. 16(*f*), the gate electrode of the thin film transistor is formed by aluminum, or the like. Subsequently, as shown in FIG. 16(*g*) and FIG. 16(*h*), impurities are injected in the thin film and the source and drain regions (phosphorus ion P for the n-type region, and boron ion B for the p-type region). In the regions where the impurities are not injected, a resist is formed. These source and drain regions are formed into a source electrode and a drain electrode respectively. Subsequently, as shown in FIG. 16(*i*), an inter-layer insulating film made from silicon dioxide or silicon nitride or the like is formed thereon. Then, as shown in FIG. 16(*j*), contact holes are formed in the inter-layer insulating film and the gate insulating film Lastly, as shown in FIG. 16(*k*), metal wires made from aluminum are formed. In this process, the highest temperature throughout the process is 600° C. in the gate insulating film forming step, a high temperature resistant glass such as Corning 1737 available from the Corning Co., Ltd., in the United States may be formed.

In the liquid crystal display device, via another inter-layer insulating film, a transparent electrode for the transmissive type or a reflective electrode for the reflective type is formed.

According to the manufacturing process shown in FIG. 16, the polycrystalline silicon thin film transistor can be manufactured at temperatures not more than around 600° C. Therefore, generally used glass substrate (a glass strain point of not more than 600° C.) without warpage or buckling. This permits the mounting process to be performed with ease, and a large area glass substrate can be manufactured at low costs, thereby obtaining an image display device of a large area at low costs.

According to the above structure, the data signal line drive circuit SD, the scanning signal line drive circuit GD, and pixels PIX all include switching elements SW made of a polycrystalline silicon thin film. Therefore, an enlargement of a display area can be achieved with ease. Furthermore, the above members can be formed on the same substrate, the manufacturing process can be simplified, and the capacitances of respective signals can be reduced. Additionally, by adopting the pre-charging circuit PC, the scanning signal line drive circuit GD and the data signal line drive circuit SD, the circuit structure can be reduced in size which permits reduction in frame area and power consumption.

As described, the first image display device of the present invention is characterized by including:

a plurality of pixels arranged in a matrix form;

a plurality of data signal lines disposed in respective columns of the pixels;

a plurality of scanning signal lines disposed in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal;

a display section including the plurality of pixels, scanning signal lines and data signal lines, for displaying an image based on a video signal as inputted to the data signal line drive circuit; and a pre-charging circuit for applying a predetermined pre-charge potential to the plurality of data signal lines based on the pre-charge control signal from an external section at a predetermined interval, wherein in a vertical retrace interval, the pre-charge potential or the signal potential is supplied to the data signal line from the pre-charging circuit or the data signal line drive circuit at least once.

According to the above structure provided with the data signal line drive circuit and the pre-charging circuit, the pre-charge potential or the signal potential is supplied to the data signal lines in the vertical retrace interval at least once. As a result, pixel potential fluctuations can be made uniform between the positive polarity side and the negative polarity side, thereby suppressing decrease in image quality.

The second image display device having the structure of the first image display device of the present invention is characterized in that: in the vertical retrace interval, the pre-charge potential is supplied from the pre-charging circuit to the data signal line at least once with respect to each polarity of an AC voltage for driving liquid crystals.

According to the described structure, in the vertical retrace interval, the pre-charge potential is supplied to the data signal line at least once with respect to each polarity of an AC voltage for driving liquid crystals. As a result, pixel potential fluctuations can be made uniform between the positive polarity side and the negative polarity side, thereby suppressing decrease in image quality.

The third image display device having the structure of the first image display device is characterized in that the display section includes liquid crystals, and in the vertical retrace interval, the pre-charge potential of a potential that is equivalent to a maximum amplitude value of the video signal of the positive polarity and to a maximum amplitude value of the video signal of negative polarity in AC driving the liquid crystals is supplied once to each data signal line from the pre-charging circuit.

According to the described arrangement, the pre-charge potential having an equivalent potential value from the maximum amplitude value of the video signal of the positive polarity and from the maximum amplitude value of the video signal of negative polarity of an AC voltage for driving the liquid crystals is supplied to each data signal line at least once in the vertical retrace interval. As a result, pixel potential fluctuations can be made uniform between the positive polarity side and the negative polarity side, and moreover, with a minimum required pre-charge of the data signal line, decrease in image quality can be suppressed without significantly increasing power consumption.

The fourth image display device having the structure of the first image display device of the present invention is characterized in that:

the pre-charge potential to be inputted to the pre-charging circuit for supplying it from the pre-charge circuit to the data signal line is an AC potential of 1 horizontal scan period.

According to the described arrangement, the pre-charge potential to be applied to the pre-charging circuit is subjected to polarity inversion at 1 horizontal scan period (hereinafter referred to as 1H) also in the vertical retrace interval. As a result, simplified drive circuit can be achieved.

The fifth image display device having the structure of the first image display device of the present invention is characterized in that the display section includes liquid crystals, and in the vertical retrace interval, a pre-charge potential of not less than 50 percent of a maximum value of the video signal of positive polarity and not less than 50 percent of the video signal of negative polarity in AC driving the liquid crystals is supplied from the pre-charging circuit to each data signal line.

According to the described structure, a pre-charge potential of not less than 50 percent of the maximum value of the video signal of positive polarity and not less than 50 percent of the video signal of the maximum value of negative polarity is supplied. Therefore, an appropriate potential can be selected according to the level of the pixel potential fluctuations, and the fluctuations in pixel potential can be made uniform between the positive polarity side and the negative polarity side. Moreover, with an minimum required pre-charge, decrease in image quality can be suppressed without significantly increasing power consumption.

The sixth image display device having the structure of the first image display device of the present invention is characterized in that:

a video signal to which a predetermined vertical retrace interval supply potential in the vertical retrace interval is sampled in the data signal line drive circuit, and a signal potential based on the sampling is supplied from the data signal line drive circuit to the each data signal line.

According to the described arrangement, a video signal to which an arbitrary vertical retrace interval supply potential in the vertical retrace interval is added is sampled, and the video signal as sampled is supplied to the data signal line at least once. As a result, pixel potential fluctuations can be made uniform between the positive polarity side and the negative polarity side, thereby suppressing decrease in image quality.

The seventh image display device of the present invention is characterized by including:

a plurality of pixels arranged in a matrix form;

a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal; and a display section including the plurality of pixels, scanning signal lines and data signal lines, for displaying an image based on a video signal to be inputted to the data signal line drive circuit, wherein the data signal line drive circuit supplies a signal potential to the plurality of data signal lines, samples a video signal to which the vertical retrace interval supply potential is added in the vertical retrace interval, and supplies a signal potential based on the sampling at least once. As a result, pixel potential fluctuations can be made uniform between the positive polarity side and the negative polarity side, thereby suppressing decrease in image quality.

According to the described arrangement, in the structure with the data signal line drive circuit but without the pre-charging circuit, the vertical retrace interval supply potential is added to the video signal, and the resulting video signal is sampled to be supplied to the data signal line at least once. As a result, pixel potential fluctuations can be made uniform between the positive polarity side and the negative polarity side, thereby suppressing decrease in image quality.

The eighth image display device having the structure of the seventh image display device of the present invention is characterized in that:

the display section includes liquid crystals, and in the vertical retrace interval, the vertical retrace interval supplying potential to be added to the video signal is varied with respect to each polarity at least once in AC driving liquid crystals, and a signal potential resulting from sampling the video signal is supplied from the data signal line drive circuit to each data signal line.

According to the described arrangement, in the vertical retrace interval, a signal potential is supplied to the data signal line at least once with respect to respective polarities of an AC voltage for driving liquid crystals. As a result, pixel potential fluctuations can be made uniform between the positive polarity side and the negative polarity side, thereby suppressing decrease in image quality.

The ninth image display device having the structure of the seventh or eighth image display device of the present invention is characterized in that:

the display section includes liquid crystals, and the vertical retrace interval supply potential is equivalent to a maximum amplitude value of the video signal of the positive polarity and to a maximum amplitude value of the video signal of negative polarity in AC driving the liquid crystals.

According to the described arrangement, the vertical retrace interval supply potential has an equivalent potential value both from the maximum amplitude value in positive polarity and the maximum amplitude value in negative polarity of the video signal. As a result, fluctuations in pixel potential can be made uniform between the positive polarity side and the negative polarity side. Moreover, with an minimum required pre-charge, decrease in image quality can be suppressed without significantly increasing power consumption.

The tenth image display device having the structure of the seventh or eighth image display device of the present invention is characterized in that the display section includes liquid crystals, and the vertical retrace interval supplying potential is an AC potential of 1 horizontal scan period.

According to the described arrangement, the vertical retrace interval supply potential is subjected to polarity inversion for 1H, simplified drive circuit can be achieved.

The eleventh image display device having the structure of the seventh or eighth image display device of the present invention is characterized in that:

the display section includes liquid crystals, and in the vertical retrace interval, the vertical retrace interval supply interval is not less than 50 percent of a maximum value of the video signal of positive polarity and not less than 50 percent of the video signal of negative polarity in AC driving the liquid crystals.

According to the described structure, a pre-charge potential of not less than 50 percent of a maximum value of the video signal of positive polarity and not less than 50 percent of the video signal of negative polarity is supplied. Therefore, an appropriate potential can be selected according to the level of the pixel potential fluctuations, and the fluctuations in pixel potential can be made uniform between the positive polarity side and the negative polarity side. Moreover, with an minimum required pre-charge, decrease in image quality can be suppressed without significantly increasing power consumption.

According to the twelfth image display device having the structure of the seventh image display device is characterized in that:

effective voltage values of respective levels supplied to the data signal line during the vertical retrace interval according to the pre-charge potential, the vertical retrace interval supply potential or a signal potential are equivalent.

According to the described arrangement, the respective effective voltage values having potentials of respective levels supplied to the data signal line during the vertical retrace interval according to the pre-charge potential, the vertical retrace interval supply potential or the signal level are equivalent among respective levels. As a result, pixel potential fluctuations can be made uniform between the positive polarity side and the negative polarity side, thereby suppressing decrease in image quality without significantly increasing power consumption.

As described, the first driving method for an image display device, which includes:

a plurality of pixels arranged in a matrix form;

a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal;

a display section including the plurality of pixels, scanning signal lines and data signal lines, for displaying an image based on a video signal to be inputted to the data signal line drive circuit; and a pre-charging circuit for supplying a predetermined pre-charge potential to the plurality of data signal lines according to the pre-charge control signal from an external section in a predetermined interval, is characterized by including the step of:

supplying in a vertical retrace interval, the pre-charge potential or the signal potential to the data signal line from the pre-charging circuit or the data signal line drive circuit at least once.

According to the above structure provided with the data signal line drive circuit and the pre-charging circuit, the pre-charge potential or the signal potential is supplied to the data signal line in the vertical retrace interval at least once. As a result, pixel potential fluctuations can be made uniform between the positive polarity side and the negative polarity side, thereby suppressing decrease in image quality.

The second driving method of the present invention for an image display device which includes:

a plurality of pixels arranged in a matrix form; a plurality of data signal lines arranged in respective columns of the pixels;

a plurality of scanning signal lines arranged in respective rows of the pixels;

a data signal line drive circuit for driving the plurality of data signal lines by outputting thereto a signal potential in synchronization with a predetermined timing signal;

a scanning signal line drive circuit for driving the plurality of scanning signal lines by outputting thereto a scanning signal in synchronization with a predetermined timing signal; and a display section including the plurality of pixels, scanning signal lines and data signal lines, for displaying an image based on a video signal to be inputted to the data signal line drive circuit, is characterized by including the step of:

supplying a signal potential to the plurality of data signal lines by the data signal line drive circuit, and sampling a video signal to which vertical retrace interval supply potential is added in the vertical retrace interval, so as to supply a signal potential based on the sampling to the data signal line at least once.

According to the described arrangement, in the structure with the data signal line drive circuit but without the pre-charging circuit, the vertical retrace interval supply potential is added to the video signal, and the resulting video signal is sampled to be supplied to the data signal line at least once. As a result, pixel potential fluctuations can be made uniform between the positive polarity side and the negative polarity side, thereby suppressing decrease in image quality.

The third driving method having the structure of the first or second driving method of the present invention is characterized in that:

the display section includes liquid crystals, and in the vertical retrace interval, the pre-charge potential or signal potential is supplied to respective polarities at least once in AC driving the liquid crystals.

According to the described structure, in the vertical retrace interval, the pre-charge potential is supplied to the data signal line at least once with respect to each polarity of an AC voltage for driving liquid crystals. As a result, pixel potential fluctuations can be made uniform between the positive polarity side and the negative polarity side, thereby suppressing decrease in image quality.

The fourth driving method having the structure of the first or second driving method of the present invention is characterized in that:

the display section includes liquid crystals, and in the vertical retrace interval, the pre-charge potential or the signal potential supplied to each data signal line is equivalent to a maximum amplitude value of the video signal of the positive polarity and to a maximum amplitude value of the video signal of negative polarity in AC driving the liquid crystals.

According to the described arrangement, the pre-charge potential having an equivalent potential value from the maximum amplitude value of the video signal of the positive polarity and from the maximum amplitude value of the video signal of negative polarity of an AC voltage for driving the liquid crystals is supplied to each data signal line at least once in the vertical retrace interval. As a result, pixel potential fluctuations can be made uniform between the positive polarity side and the negative polarity side, and moreover, with a minimum required pre-charge of the data signal line, decrease in image quality can be suppressed without significantly increasing power consumption.

The fifth driving method having the structure of the first or second driving method of the present invention is characterized in that:

the pre-charge potential or the vertical retrace interval supplying potential in the vertical retrace interval is an AC potential of 1 horizontal scan period.

According to the described arrangement, the pre-charge potential to be applied to the pre-charging circuit is subjected to polarity inversion at 1 horizontal scan period (hereinafter referred to as 1H) also in the vertical retrace interval. As a result, simplified drive circuit can be achieved.

The sixth driving method having the structure of the first through third or fifth driving method of the present invention is characterized in that:

the display section includes liquid crystals, and in the vertical retrace interval, the pre-charge potential or the signal potential to be supplied to each data signal line is not less than 50 percent of a maximum value of the video signal of positive polarity and not less than 50 percent of the video signal of negative polarity in AC driving the liquid crystals.

According to the described structure, a pre-charge potential of not less than 50 percent of the maximum value of the video signal of positive polarity and not less than 50 percent of the video signal of the maximum value of negative polarity is supplied. Therefore, an appropriate potential can be selected according to the level of the pixel potential fluctuations, and the fluctuations in pixel potential can be made uniform between the positive polarity side and the negative polarity side. Moreover, with an minimum required pre-charge, decrease in image quality can be suppressed without significantly increasing power consumption.

The embodiments and concrete examples of implementation discussed in the foregoing detailed explanation of the present invention serve solely to illustrate the technical contents of the present invention, which should not be narrowly interpreted within the limits of such concrete examples, but rather may be applied in many variations without departing from the spirit of the present invention and the scope of the patent claims set forth below.

What is claimed is:

1. An image display device, comprising:

a plurality of pixels disposed in a matrix form;

a plurality of data signal lines disposed in respective columns of the pixels;

a plurality of scanning signal lines disposed in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal inputted to the data signal line drive circuit; and a pre-charging circuit for supplying a predetermined pre-charge potential to said plurality of data signal lines according to the pre-charge control signal from an external section at a predetermined interval, wherein in a vertical retrace interval, the pre-charge potentials of positive and negative polarities are each supplied in a lump sum to said data signal line from said pre-charging circuit at least once.

2. The image display device as set forth in claim 1, wherein:

said display section includes liquid crystals, and in the vertical retrace interval, the pre-charge potential is supplied from said pre-charging circuit to said data signal line at least once with respect to each polarity of an AC voltage for driving liquid crystals.

3. The image display device as set forth in claim 1, wherein:

said display section includes liquid crystals, and in the vertical retrace interval, the pre-charge potential of a potential that is equivalent to a maximum amplitude value of the video signal of the positive polarity and to a maximum amplitude value of the video signal of negative polarity in AC driving the liquid crystals is supplied once to each data signal line from said pre-charging circuit.

4. The image display device as set forth in claim 1, wherein:

said pre-charge potential to be inputted to said pre-charging circuit for supplying it from said pre-charging circuit to said data signal line is an AC potential of 1 horizontal scan period.

5. The image display device as set forth in claim 1, wherein:

said display section includes liquid crystals, and in the vertical retrace interval, a pre-charge potential of not less than 50 percent of a maximum value of the video signal of positive polarity and not less than 50 percent of the video signal of negative polarity in AC driving the liquid crystals is supplied from said pre-charging circuit to each data signal line.

6. The image display device as set forth in claim 1, wherein:

effective voltage values of respective levels supplied to said data signal line during the vertical retrace interval according to the pre-charge potential or the vertical retrace interval supply potential are equivalent.

7. The image display device as set forth in claim 1, wherein:

said display section includes liquid crystals, and the vertical retrace interval supplying potential is an AC potential of 1 horizontal scan period.

8. An image display device, comprising:

a plurality of pixels arranged in a matrix form;

a plurality of data signal lines arranged in respective columns of the pixels;

a plurality of scanning signal lines arranged in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal; and a display section including said plurality of pixels, scanning signal lines and data signal lines, for displaying an image based on a video signal to be inputted to the data signal line drive circuit, wherein said data signal line drive circuit supplies a signal potential to said plurality of data signal lines, samples a video signal to which the vertical retrace interval supply potential is added by supplying a data sampling start signal to said data signal line drive circuit in the vertical retrace interval, and supplies a signal potential based on the sampling at least once.

9. The image display device as set forth in claim 8, wherein:

said display section includes liquid crystals, and in the vertical retrace interval, the vertical retrace interval supplying potential to be added to the video signal is varied with respect to each polarity at least once in AC driving liquid crystals, and a signal potential resulting from sampling the video signal is supplied from the data signal line drive circuit to each data signal line.

10. The image display device as set forth in claim 8, wherein:

said display section includes liquid crystals, and the vertical retrace interval supply potential is equivalent to a maximum amplitude value of the video signal of the positive polarity and to a maximum amplitude value of the video signal of negative polarity in AC driving the liquid crystals.

11. The image display device as set forth in claim 8, wherein:

said display section includes liquid crystals, and in the vertical retrace interval, the vertical retrace interval supply interval is not less than 50 percent of a maximum value of the video signal of positive polarity and not less than 50 percent of the video signal of negative polarity in AC driving the liquid crystals.

12. The image display device as set forth in claim 8, wherein:

effective voltage values of respective levels supplied to said data signal line during the vertical retrace interval according to the pre-charge potential, the vertical retrace interval supply potential or a signal potential are equivalent.

13. A driving method for an image display device, which comprises:

a plurality of pixels arranged in a matrix form;

a plurality of data signal lines arranged in respective columns of the pixels;

a plurality of scanning signal lines arranged in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal to be inputted to the data signal line drive circuit; and a pre-charging circuit for supplying a predetermined pre-charge potential to said plurality of data signal lines according to the pre-charge control signal from an external section in a predetermined interval, said driving method comprises the step of:

supplying in a lump sum in a vertical retrace interval, the pre-charge potentials of positive and negative polarities to said data signal line from said pre-charging circuit at least once.

14. The driving method as set forth in claim 13, wherein:

said display section includes liquid crystals, and in the vertical retrace interval, the pre-charge potential is supplied to respective polarities at least once in AC driving the liquid crystals.

15. The driving method as set forth in claim 13, wherein:

said display section includes liquid crystals, and in the vertical retrace interval, the pre-charge potential supplied to each data signal line is equivalent to a maximum amplitude value of the video signal of the positive polarity and to a maximum amplitude value of the video signal of negative polarity in AC driving the liquid crystals.

16. The driving method as set forth in claim 13, wherein:

the pre-charge potential or the vertical retrace interval supplying potential in the vertical retrace interval is an AC potential of 1 horizontal scan period.

17. The driving method as set forth in claim 13, wherein:

said display section includes liquid crystals, and in the vertical retrace interval, the pre-charge potential to be supplied to each data signal line is not less than 50 percent of a maximum value of the video signal of positive polarity and not less than 50 percent of the video signal of negative polarity in AC driving the liquid crystals.

18. A driving method of an image display device which comprises:

a plurality of pixels arranged in a matrix form;

a plurality of data signal lines arranged in respective columns of the pixels;

a plurality of scanning signal lines arranged in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal; and a display section including said plurality of pixels, scanning signal lines and data signal lines, for displaying an image based on a video signal to be inputted to the data signal line drive circuit, said driving method comprising the step of:

supplying a signal potential to said plurality of data signal lines by said data signal line drive circuit, and sampling a video signal to which vertical retrace interval supply potential is added by supplying a data sampling start signal to said data signal line drive circuit in the vertical retrace interval, so as to supply a signal potential based on the sampling to said data signal line at least once.

19. The liquid crystal display device as set forth in claim 18, wherein:

said display section includes liquid crystals, and in the vertical retrace interval, the pre-charge potential or signal potential is supplied to respective polarities at least once in AC driving the liquid crystals.

20. The driving method as set forth in claim 18, wherein:

said display section includes liquid crystals, and in the vertical retrace interval, the pre-charge potential or the signal potential supplied to each data signal line is equivalent to a maximum amplitude value of the video signal of the positive polarity and to a maximum amplitude value of the video signal of negative polarity in AC driving the liquid crystals.

21. The driving method as set forth in claim 18, wherein:

the pre-charge potential or the vertical retrace interval supplying potential in the vertical retrace interval is an AC potential of 1 horizontal scan period.

22. The driving method as set forth in claim 18, wherein:

said display section includes liquid crystals, and in the vertical retrace interval, the pre-charge potential or the signal potential to be supplied to each data signal line is not less than 50 percent of a maximum value of the video signal of positive polarity and not less than 50 percent of the video signal of negative polarity in AC driving the liquid crystals.

23. An image display device, comprising:

a plurality of pixels disposed in a matrix form;

a plurality of data signal lines disposed in respective columns of the pixels;

a plurality of scanning signal lines disposed in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal inputted to the data signal line drive circuit, wherein the display section includes liquid crystals; and a pre-charging circuit for supplying a predetermined pre-charge potential to said plurality of data signal lines according to the pre-charge control signal from an external section at a predetermined interval, wherein in a vertical retrace interval, the pre-charge potential of a potential that is equivalent to a maximum amplitude value of the video signal of positive polarity and to a maximum amplitude value of the video signal of negative polarity in AC driving the liquid crystals is supplied once to each data signal line from said pre-charging circuit.

24. An image display device, comprising:

a plurality of pixels disposed in a matrix form;

a plurality of data signal lines disposed in respective columns of the pixels;

a plurality of scanning signal lines disposed in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal inputted to the data signal line drive circuit, wherein the display section includes liquid crystals; and a pre-charging circuit for supplying a predetermined pre-charge potential to said plurality of data signal lines according to the pre-charge control signal from an external section at a predetermined interval, wherein in a vertical retrace interval, the pre-charge potential of not less than 50 percent of a maximum value of the video signal of positive polarity and not less than 50 percent of the video signal of negative polarity in AC driving the liquid crystals is supplied from said pre-charging circuit to each data signal line.

25. A driving method for an image display device, which comprises:

a plurality of pixels arranged in a matrix form;

a plurality of data signal lines arranged in respective columns of the pixels;

a plurality of scanning signal lines arranged in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal to be inputted to the data signal line drive circuit, wherein the display section includes liquid crystals; and a pre-charging circuit for supplying a predetermined pre-charge potential to said plurality of data signal lines according to the pre-charge control signal from an external section in a predetermined interval, said driving method comprises the step of:

supplying in a vertical retrace interval, the pre-charge potential to said data signal line from said pre-charging circuit at least once, wherein the pre-charge potential supplied to each data signal line is equivalent to a maximum amplitude value of the video signal of positive polarity and to a maximum amplitude value of the video signal of negative polarity in AC driving the liquid crystals.

26. A driving method for an image display device, which comprises:

a plurality of pixels arranged in a matrix form;

a plurality of data signal lines arranged in respective columns of the pixels;

a plurality of scanning signal lines arranged in respective rows of the pixels;

a data signal line drive circuit for driving said plurality of data signal lines by outputting thereto a signal potential in synchronization with a predetermined timing signal;

a scanning signal line drive circuit for driving said plurality of scanning signal lines by outputting thereto a scanning signal in synchronization with a predetermined timing signal;

a display section including said plurality of pixels, scanning signal lines and data signal lines, for displaying an image based on a video signal to be inputted to the data signal line drive circuit, wherein the display section includes liquid crystals; and a pre-charging circuit for supplying a predetermined pre-charge potential to said plurality of data signal lines according to the pre-charge control signal from an external section in a predetermined interval, said driving method comprises the step of:

supplying in a vertical retrace interval, the pre-charge potential to said data signal line from said pre-charging circuit at least once, wherein the pre-charge potential to be supplied to each data signal line is not less than 50 percent of a maximum value of the video signal of positive polarity and not less than 50 percent of the video signal of negative polarity in AC driving the liquid crystals.

* * * * *